US007524236B2

(12) United States Patent
Schwaiger et al.

(10) Patent No.: US 7,524,236 B2
(45) Date of Patent: Apr. 28, 2009

(54) SHARPENER ACCESSORY AND METHODS RELATING TO SAME

(75) Inventors: Barry Martin Schwaiger, Hampshire, IL (US); John Robert Arne, Rockford, IL (US)

(73) Assignee: WMH Tool Group, Inc., Elgin, IL (US)

( * ) Notice: Subject to any disclaimer, the term of this patent is extended or adjusted under 35 U.S.C. 154(b) by 0 days.

(21) Appl. No.: 11/677,344

(22) Filed: Feb. 21, 2007

(65) Prior Publication Data

US 2007/0218819 A1 Sep. 20, 2007

Related U.S. Application Data

(60) Provisional application No. 60/775,375, filed on Feb. 21, 2006.

(51) Int. Cl.
*B24B 7/00* (2006.01)

(52) U.S. Cl. ..... 451/276; 451/356; 451/366; 451/396

(58) Field of Classification Search ..... 451/367, 451/266, 293, 276, 366, 387, 405
See application file for complete search history.

(56) References Cited

U.S. PATENT DOCUMENTS

| | | | | |
|---|---|---|---|---|
| 246,625 | A | 9/1881 | Merrill | |
| 264,726 | A | 9/1882 | Maltby | |
| 277,882 | A | 5/1883 | Carr | |
| 494,893 | A | 4/1893 | Ross, Jr. | |
| 1,118,684 | A | 11/1914 | Ross | |
| 1,171,569 | A | 2/1916 | Wanda | |
| 1,279,025 | A * | 9/1918 | Shay | 451/367 |
| 2,128,591 | A | 8/1938 | McGill | |
| 2,369,642 | A * | 2/1945 | Benning | 451/375 |
| 2,398,306 | A | 4/1946 | Hermanson | |
| 2,411,609 | A * | 11/1946 | Zenick | 451/375 |
| 2,468,395 | A | 4/1949 | Fredin | |
| 2,505,215 | A | 4/1950 | Siegerist | |
| 2,583,159 | A * | 1/1952 | Swanson | 451/375 |
| 2,887,833 | A * | 5/1959 | Passarotti | 451/367 |
| 2,911,771 | A | 11/1959 | Amiet | |
| 2,922,263 | A * | 1/1960 | Bogert, Sr. | 451/377 |
| 2,998,683 | A | 9/1961 | Wegener | |

(Continued)

FOREIGN PATENT DOCUMENTS

DE 69921228 3/2006

(Continued)

OTHER PUBLICATIONS

"Scheppach grinds", TiGer 2000, Wet Grinding System.

(Continued)

*Primary Examiner*—Maurina Rachuba
(74) *Attorney, Agent, or Firm*—Fitch, Even, Tabin & Flannery

(57) ABSTRACT

A tool sharpener accessory having a base mounted on a support, a pivoting member pivotally mounted on the base and pivoting in at least a seesaw motion relative to the base, the pivoting ember having an axis of rotation adaptable for extending transverse to the axis of rotation of the grinding stone, and a securing mechanism for securing the tool to the pivoting member.

49 Claims, 24 Drawing Sheets

U.S. PATENT DOCUMENTS

| | | | | | |
|---|---|---|---|---|---|
| 3,030,131 | A | | 4/1962 | Scherry | |
| 3,252,223 | A | | 5/1966 | Gettel | |
| 3,298,106 | A | | 1/1967 | Duvall | |
| 3,482,325 | A | | 12/1969 | Mitchell | |
| 3,730,569 | A | | 5/1973 | Feinler | |
| 4,005,553 | A | * | 2/1977 | Eller | 451/367 |
| 4,095,376 | A | * | 6/1978 | Lotane | 451/367 |
| 4,142,332 | A | * | 3/1979 | Clarke | 451/278 |
| 4,435,103 | A | | 3/1984 | Becker et al. | |
| 4,483,104 | A | | 11/1984 | Welliver | |
| 4,547,999 | A | | 10/1985 | Reiling et al. | |
| 4,936,053 | A | | 6/1990 | Shanelec | |
| 5,218,787 | A | | 6/1993 | Rice | |
| 5,301,473 | A | | 4/1994 | Seear | |
| 5,331,774 | A | | 7/1994 | Domenella | |
| D366,662 | S | | 1/1996 | Haffely et al. | |
| 5,527,208 | A | * | 6/1996 | Blake et al. | 451/367 |
| 5,611,149 | A | | 3/1997 | Fujiwara | |
| 5,810,649 | A | | 9/1998 | Oar et al. | |
| 5,816,735 | A | | 10/1998 | Jansson | |
| 5,938,511 | A | * | 8/1999 | Patterson | 451/377 |
| 6,067,721 | A | | 5/2000 | Dall'aglio et al. | |
| 6,189,225 | B1 | | 2/2001 | Jansson | |
| 6,254,455 | B1 | | 7/2001 | Irvine et al. | |
| D447,155 | S | | 8/2001 | Lin Ku | |
| 6,305,623 | B1 | | 10/2001 | Sotsky et al. | |
| 6,393,712 | B1 | | 5/2002 | Jansson | |
| 6,447,384 | B1 | | 9/2002 | Jansson | |
| 6,623,340 | B2 | | 9/2003 | Jansson | |
| D490,522 | S | | 5/2004 | Jansson | |
| D505,683 | S | | 5/2005 | Pfaff | |
| 6,926,596 | B1 | * | 8/2005 | Tarris | 451/367 |
| 2005/0176355 | A1 | * | 8/2005 | Tarris | 451/367 |
| 2005/0287934 | A1 | | 12/2005 | Jansson | |

FOREIGN PATENT DOCUMENTS

| | | | | |
|---|---|---|---|---|
| DE | 202006003540 | U | | 6/2006 |
| EP | 225806 | A2 | * | 6/1987 |
| EP | 0958888 | | | 11/1999 |
| EP | 1604778 | | | 12/2005 |
| FR | 2671385 | | | 7/1992 |
| JP | 2000024887 | | | 1/2000 |
| WO | 9502771 | | | 1/1995 |

OTHER PUBLICATIONS

Klenck, Thomas, "True Grit", Dec. 14, 2004, www.popularmechanics.com/home_improvement/workshop/1303016.html?page=&c=y...

"Craftsman 6 in. Bench Grinding Center with Goose Neck Lamp", Jul. 13, 2005, www.sears.com/sr/javasr/product.do?BV_UseBVCookie=Yes&vertical=TOOL...

"TiGer 2000", Sep. 9, 2005, www.scheppach.com.

Dresdner, Michael, "New Offerings for Woodworking's JET Set.", Oct. 24, 2006-Nov. 6, 2006, Issue 160, Woodworker's Journal EZine.

Hintz, Tom, "JET Slow Speed Wet Sharpener", Oct. 10, 2006, Newwoodworker.com.

Hintz, Tom, "JET & Tormek Wet Sharpeners", Oct. 13, 2006, Newwoodworker.com.

Lowry, Pat, "Move over, Tormek; Jet's Wet Sharpener is here", Jul. 2007, p. 86, Issue 177, WOOD Magazine.

Hintz, Tom, "Tormek TTS-100 Turning Tool Setter", Aug. 9, 2006, Newwoodworker.com.

www.tormekshop.com.au/images/tts100.jpg, Oct. 3, 2006.

www.tormek.com/images/introduction/photo/svd-180-big.jpg, Oct. 3, 2006.

"All Purpose Wet-dry-grinder to grind metals, glas, stone and other materials", accessed Jan. 25, 2008, www.holzstar-machines.com/current-informations/news/details...

www.holzstar-machines.com, accessed Jan. 25, 2008.

"Wet-dry-grinder NTS 251—Universally applicable wet-dry-grinder to grind metal, glass, stones and other materials", accessed Jan. 25, 2008, www.holzstar-machines.com/products/wet-dry-grinder/index.html.

* cited by examiner

SHARPENER ACCESSORY AND METHODS RELATING TO SAME

CROSS-REFERENCE TO RELATED APPLICATION

This application claims the benefit of U.S. Provisional Application No. 60/775,375, filed Feb. 21, 2006, which is hereby incorporated herein by reference in its entirety.

FIELD OF THE INVENTION

The present invention relates to sharpening a cutting edge on cutting tools and, more particularly, to wet sharpeners with a wet, rotating grinding stone, and accessories used in conjunction therewith to sharpen the cutting edge on cutting tools.

BACKGROUND OF THE INVENTION

Tool sharpeners, such as grinders, are used to sharpen cutting edges on wood carving tools, such as cabinet maker tools, chisels, gouges, and the like, and cutting tools, such as plane blades, jointer blades, axes, scissors, knives, and the like. Typically, wet sharpeners have a rotating abrasive grinding wheel mounted along the side of a motor housing where the rim of the grinding stone is kept wet by having it rotate through a tray holding water. The water provides a slight level of lubrication between the tool being sharpened and the rim of the grinding stone to prevent overheating and damaging the tool being sharpened (e.g., burning the tool edge, removing the temper or causing a loss in hardness of the metal tool being sharpened), as well as to decrease the wear of the grinding stone. Some wet sharpeners provide a second grinding, honing or polishing wheel mounted on the opposite side of the housing as the first grinding stone. In view of the multiple uses for such tool sharpeners, the term sharpening as used herein will generally refer to all uses of such tool sharpeners including, but not limited to, grinding, sharpening, honing, polishing, etc.

The sharpener typically has many accessories such as jigs or support tools used to hold carving and cutting tools on a support bar in front of the grinding stone in order to keep the tool steady when it is placed against the grinding stone. A number of small separate gauges also are used to configure the jigs for a desired grinding angle or to measure cutting edge sizes on the tools. Since these numerous accessories are separate from the sharpener and its supports, they can often be lost or misplaced rather easily. Thus, a convenient storage compartment or space is desired to address this problem.

The grinding stone mounted on the side of the motor housing is typically rotated at a single, low speed in order to maintain a certain amount of moisture on the grinding stone rim. However, protracted use causes a reduction of the diameter of the wet grinding wheel and, accordingly, decreases the outer rim or surface speed of the grinding wheel. For example, a 10" diameter wheel worn down to a 6" diameter, results in a 40% reduction in surface speed. Erosion of the wet grinding wheel reduces the ability of the grinding wheel to efficiently cut and sharpen a tool (i.e., reduces "cutting aggression"). A wet sharpener is needed that can compensate for this erosion.

Known dry wheel bench grinders, employ a variable speed motor for careful sharpening of fine edges to vary the aggressiveness of the grinding. However, such grinders operate at speeds that are too high to be used with wet sharpeners, such as for example ranges of 2000 RPM and faster. Speeds this high cannot be used on wet sharpeners because at such a high speed, the water is thrown off of the grinding stone and does not adhere to the rim of the grinding stone. Without sufficient water on its rim, the grinding wheel will undesirably wear and overheat. Therefore, it is desirable to address these shortcomings as well as those associated with grinding wheel erosion discussed above.

Conventional wet sharpeners further employ a pendulum structure where the motor hangs from a bar and is free to swing relative to the grinding stone rim. Gravity holds the motor, and more specifically the motor's drive shaft, against the drive wheel of the grinding stone. This enables the motor to rotate the grinding stone purely through friction between its rotating drive shaft and the grinding stone drive wheel.

The gravity-friction based drive force, however, is not always adequate to rotate the grinding stone at a constant speed (constant RPM) or to rotate the grinding stone fast enough. In addition, other factors such as contaminates or liquids on the contact points between the drive wheel rim and drive shaft can further reduce the friction coefficient of the contact. Thus, a need exists for a wet sharpener that provides a stronger frictional force than a simple pendulum-gravity configuration and that can compensate for debris or liquids that reduce friction at the contact points.

The typical, rotating grinding stone is mounted on the side of a sharpener's motor housing and is held near a horizontally extending, support bar also mounted on the motor housing. The support bar supports different jigs which, in turn, support the tool while being sharpened by the grinding stone. The jigs hold the tool at selected angles relative to the grinding stone as the tool is placed in contact with the abrasive, outer rim of the grinding stone.

One such jig is a straight edge jig. This jig includes a base plate that mounts on the sharpener support bar while the tool to be sharpened, such as a flat, hand plane iron, is placed across the base plate of the jig. An upper plate is placed over the tool, to clamp the tool between the base and upper plate. The straight edge jig can be rotated away and toward the grinding stone (i.e., rotated about the horizontal support bar so that the axis of rotation of the jig is parallel to the axis of rotation of the grinding stone). The jig is rotated to select the angle of the tool relative to the grinding stone surface, as well as moved side-to-side along the support bar in front of the grinding stone to sharpen or form a straight cutting edge on the tool.

Another jig is disclosed by U.S. Pat. No. 6,447,384. This jig holds a tool in a casing that can be swiveled horizontally to a range of inclined positions relative to the base of the jig, the support bar and the grinding stone. The jig also can be rotated vertically upon the support bar in a range of grinding angles relative to the grinding stone.

While these jigs enable sharpening or creation of a curved cutting edge, which is horizontal or inclined, they do not enable creation of a true 'vertical' cambered surface or cutting edge where the side edges of a flat plate or iron cutting tool are thinner than at the center of the cutting tool. In addition, the jig disclosed by the '384 patent is particularly suited to hold round or beveled tools in its V-shaped seats. While it can hold flat tools, the user tends to have a difficult time arranging the flat tool or iron to sit level within the V-shaped seat of the jig.

U.S. Pat. No. 6,393,712 discloses a multi-jointed arm jig with an elbow joint and wrist joint for sharpening or forming curved surfaces on round tools, such as cylindrical gouges, held at the end of the arm. These jigs, however, do not hold flat tools or irons.

Currently, the only way to create a cambered edge on a flat tool held by these jigs is to manually twist the tool as it is placed along the thickness of the grinding stone. Thus, no way exists to obtain identical cuts from tool-to-tool since the cuts are made by hand.

A need exists for a camber jig that provides support for a flat tool, such as a hand plane iron, while easily forming a cambered cutting edge on the tool without the need for manually twisting or turning the tool by hand. A need also exists to make a repeatable process to produce the same camber on multiple tools.

In addition to jigs, gauges are often used with tool sharpeners in order to recreate the conditions for forming a particularly shaped cutting edge on a tool and for determining the exact angles created on tools. Some gauges are provided for measuring the grinding angle (i.e., the angle of the tool held in a jig or on a tool support relative to the tangent line where the tool meets the circular grinding surface on a grinding stone).

U.S. Pat. No. 6,189,225 discloses a grinding angle gauge that can be used on grinding stones or wheels of varying diameters. The angle gauge includes two adjustable pointers on opposite ends of a frame. At one end, a rounded end of a pointer rests on the grinding stone and can be turned to delineations of the diameter of the wheel. The pointer at the other end of the frame has a flat end for placement on a tool support, jig, or tool at the point where the implement contacts the grinding stone. The pointed end of the second pointer will indicate the angle of the support or jig. One shortcoming with such gauges, however, is that they are often difficult to operate and cost more due to their complex construction. Thus, a less expensive, less complicated gauge is desired for measuring this angle.

Other known gauges are used for measuring the diameter of the grinding wheel or the angle of the cutting edge on the tool. These known gauges, however, are frequently cumbersome to use, inaccurate and cannot be conveniently stored on the sharpener. Thus, a need also exists for gauges that address these shortcomings.

DESCRIPTION OF THE PREFERRED EMBODIMENTS

Figure 1:
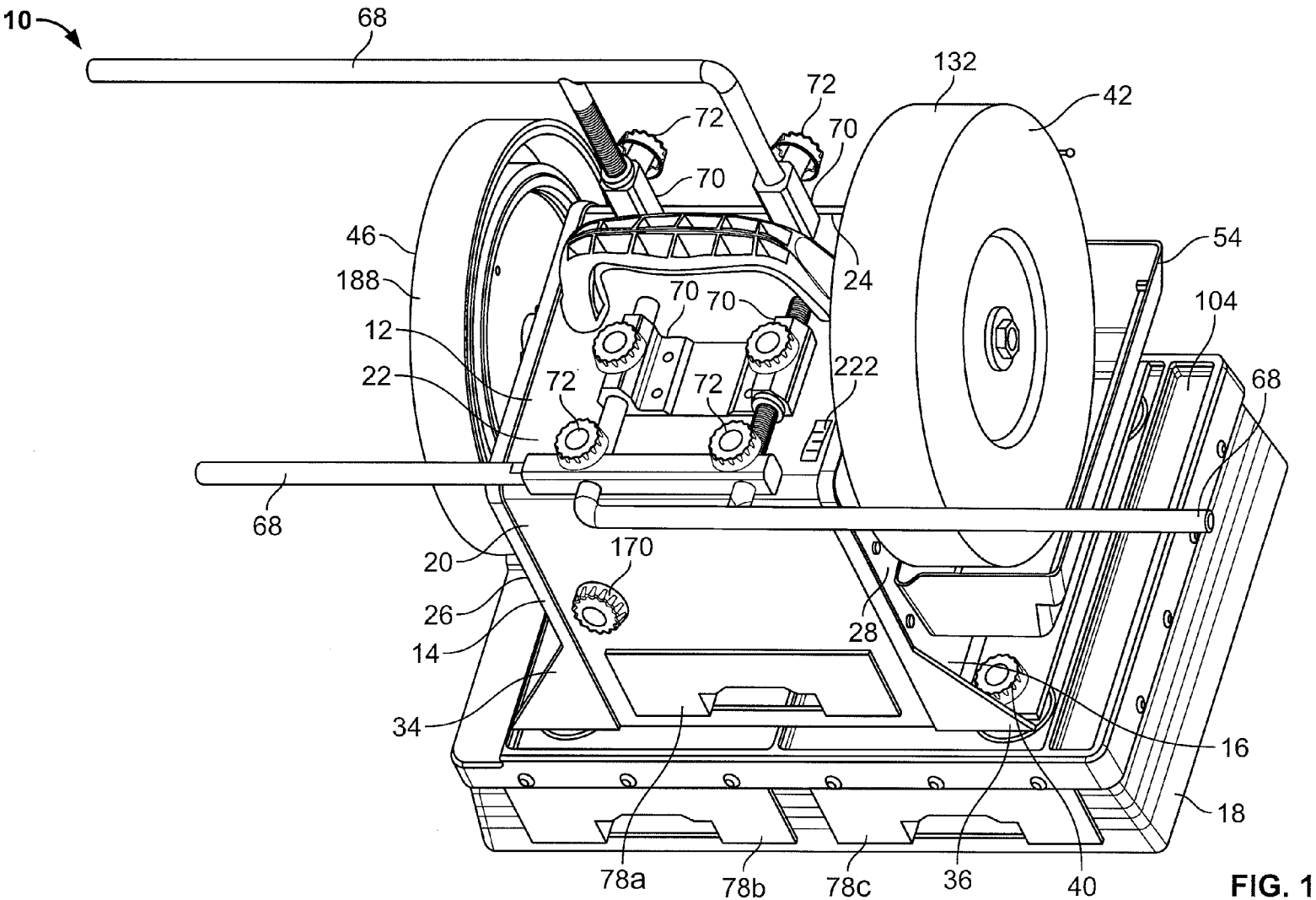
FIG. 1 is a perspective view of a wet sharpener embodying features of the present invention.

Referring to FIG. 1, there is illustrated a tool sharpener 10 with a housing 12, having a left sidewall 14, a right sidewall 16 and front, top and rear side panels 20, 22 and 24, respectively. The housing 12 is disposed on top of a base 18, such as a pedestal, and has an integrally formed front panel 20, top panel 22 and back panel 24 (shown in FIG. 2), although the panels could be manufactured separately. In an alternative form, the tool sharpener 10 can be provided without the base 18, as shown in FIG. 3.

Each sidewall 14, 16 of the housing 12 has a side panel 26, 28 respectively enclosing the interior of the housing 12 and that ends at a bottom plate 30 or 32 extending perpendicular from a corresponding side panel 26 or 28 in order to form a widened base. Each sidewall 14, 16 also has a respective corresponding front, triangular brace 34, 36, and backward extending triangular braces 35, 37 (shown on FIGS. 5 and 12) which adds further support for the left and right side panels 26, 28. In a preferred form, the side walls 14, 16 are fastened to the front panel 20 and the back panel 24 via fasteners, such as screws, which are screwed into mating threaded bores connected to the front and back panels 20, 24. It should be understood, however, that in alternate embodiments, these components may be connected via other fasteners, such as rivets, bolts, adhesives, or the like, or even may be configured to snap together or be formed integrally with panels 20, 22 and 24, if desired.

As shown in FIGS. 1-5, four feet 38 are fastened (e.g., adhered) to the bottom plates 30, 32 of the side panels 14, 16 and have through-holes 39 for receiving a fastener 40, such as a threaded shank (not shown) of a gnarled head or knob. The fastener 40 is placed through the through-holes 39 of the feet 38 and into threaded apertures 41 on top wall 104 of the base 18 for securing the housing 12 to the optional base 18. A circular, raised rib 45 or other alignment structure surrounds each aperture 41 to align the feet 38 with the apertures. For example, in the form shown, the feet 38 are generally cylindrical rubber members that may be used to support the sharpener 10 when the optional base 18 is not used. Alternatively, if base 18 is used, the round cylindrical foot members are positioned within the circular raised rib 45 of the base 18 to align the opening of the base 18 with the opening of the feet 38 so that the housing 12 may be connected to the tool sharpener base 18 via fasteners such as screws. It should be understood, however, that in alternate embodiments the aperture may be formed by bushings or other structures when the top wall 104 of the base 18 is not made of a material suitable for receiving a fastener directly.

Figure 4:
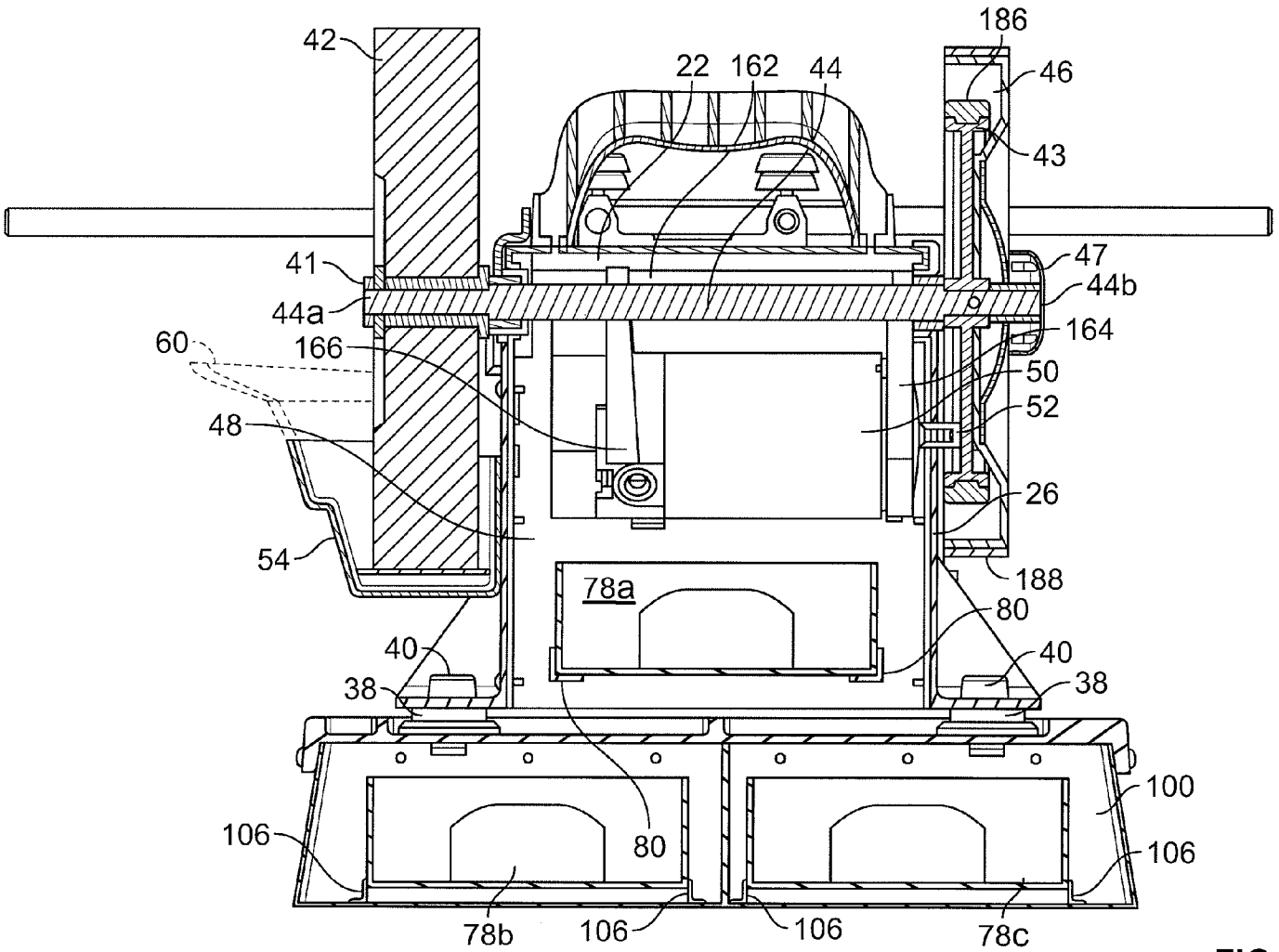
FIG. 4 is a rear cross-sectional view of the wet sharpener of FIG. 1.

Referring to FIG. 4, a grinding stone 42 is disposed adjacent the housing 12, and is mounted on a rotatable axle 44 that extends through side panel 28, through the interior 48 of housing 12, and out the left side panel 26 where the axle 44 engages a honing wheel 46 so that the honing wheel 46 and the grinding stone 42 rotate together. More particularly, a threaded end 44*a* of axel 44 is inserted through the central opening of grinding stone 42. A fastener, such as nut 41, is attached to the distal end of threaded end 44*a* and tightened to firmly and securely connect the grinding stone 42 to the axel 44. Thus, when assembled, the grinding stone 42 rotates along with the axel 44.

The grinding stone illustrated is made of a ceramic material containing aluminum-oxide and may be provided in a wide range of grit ratings. For example, for some applications a very coarse grit, such as a 200 grit stone, may be desired. For other applications, a much more fine grit, such as a 1000 grit stone, may be desired. Thus, it should be understood that the material and coarseness/fineness of the stone may be varied over a wide range depending on the application for which the operator wishes to use the sharpener 10.

In the embodiment illustrated, a honing wheel 46 is connected to the opposite end of axel 44 in a manner similar to that of the grinding stone 42. More particularly, the threaded end 44*b* of axel 44 is inserted through the central opening in honing wheel 46. The honing wheel 46 is then fastened to the axel 44 via a fastener, such as nut cap 47. A washer may be placed between the nut 47 and the honing wheel 46 in order to more securely fasten the honing wheel 46 to the axel 44. Thus, once assembled, rotation of honing wheel 46 will result in corresponding rotations of axel 44 and grinding stone 42 connected thereto.

A motor 50 is also disposed in the interior 48 of the housing 12 and rotates a drive shaft 52 that rotates the honing wheel 46, which in turn, rotates the axle 44 and the grinding stone 42. The drive shaft 52 extends out of the motor 50 and through the left side panel 26 in order to contact the honing wheel 46. It will be appreciated, however, that other structures for rotating the wheels 42, 46 are contemplated such as a motor that rotates the grinding stone directly instead of the honing wheel or only rotates the grinding stone 42, such as a direct drive arrangement wherein the motor directly drives the grinding stone 42, or other embodiments such as a geared transmission wherein the drive shaft 52 drives a gear or gears which in turn drive at least one of the wheels 42, 46.

Figure 5:
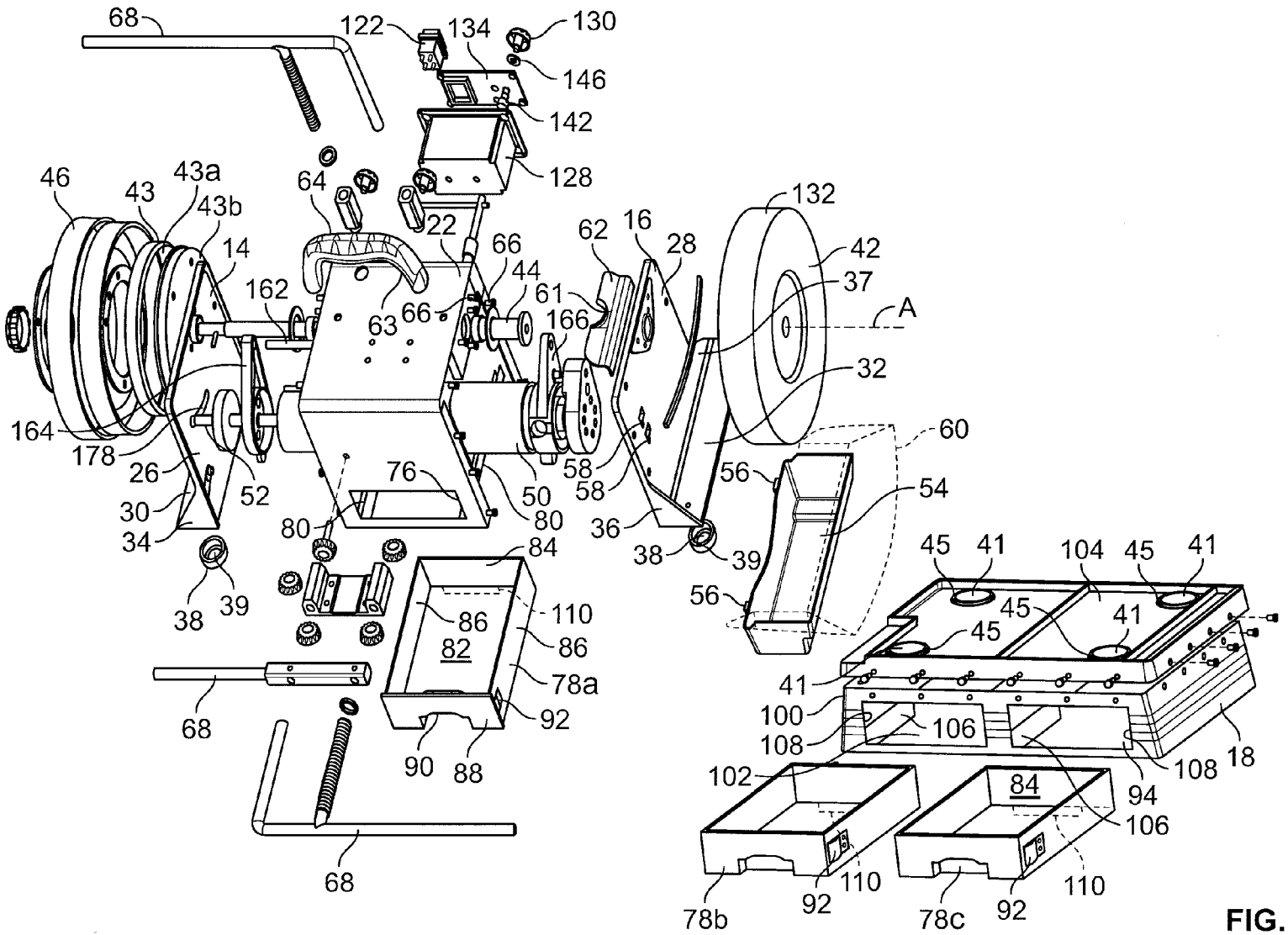
FIG. 5 is an exploded view of the wet sharpener of FIG. 1.

Referring to FIGS. 1 and 5, a coolant reservoir or container 54, such as a tray or a pan, is mounted beneath the grinding stone 42 in order to keep the rotating grinding stone 42 in contact with the coolant, such as water or other liquids, in the container 54. This maintains the grinding wheel 42 below a predetermined temperature to reduce wear of the wheel. In the embodiment shown, the container 54 is mounted on the right panel 28 of the right side wall 16 and has a left hook 56 that engages one of at least two openings 58 defined by the right panel 28 which provide alternative height positions for the container. A right hook 57 on the container 54 engages one of at least two backwardly extending tabs 66 (best seen in FIGS. 9-10) that are integrally formed with, and bent from, back panel 24. In the form illustrated, sidewall 16 has a rim 67 with holes 69 to permit access to the tabs 66. Thus, the hooks formed by the container 54 mate with the lips formed by the sidewall 16 and the tabs 66 to hold the container in the desired location with respect to the grinding wheel 42 and housing 12.

The purpose for offering a plurality of positions to mount the container 54 to the housing 12 is to allow the user to adjust the height of the container 54 when either the diameter of the wheel 42 has shrunk due to wear or the water level in the container 54 has dropped and cannot be readily replaced or replenished. Although the embodiment illustrated uses mating hooks and lips for releasably connecting the container 54 to the housing 12, it should be understood that any number of different mating structures may be used to connect the container 54 to the housing 12, such as for example, tenon and mortise structures, hook and loop structures, buttons, clips, etc. For example, in one alternate embodiment, the container 54 may define openings to which hooks extending from the housing 12 are connected.

Figure 2:
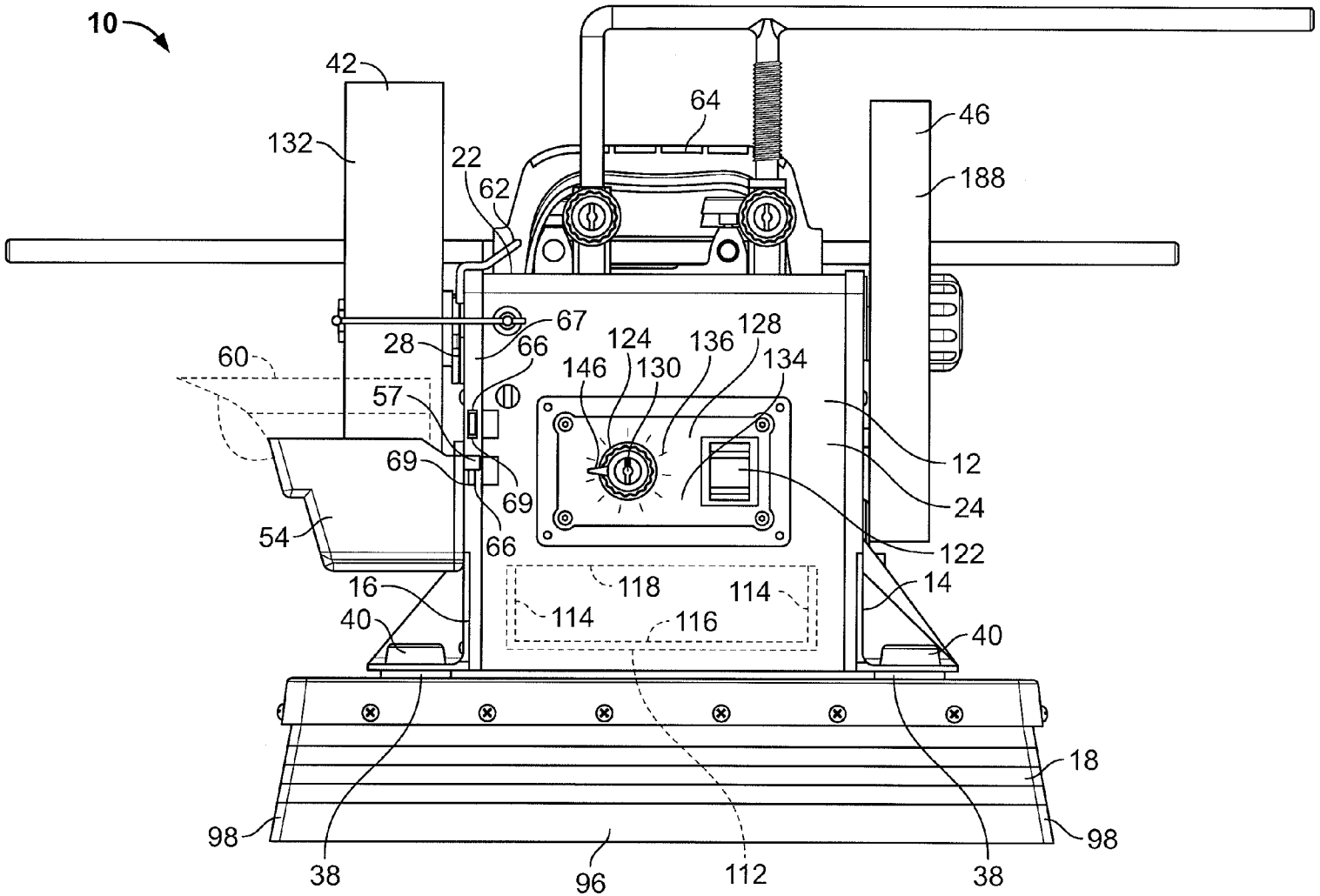
FIG. 2 is a rear elevational view of the wet sharpener of FIG. 1.
Figure 3:
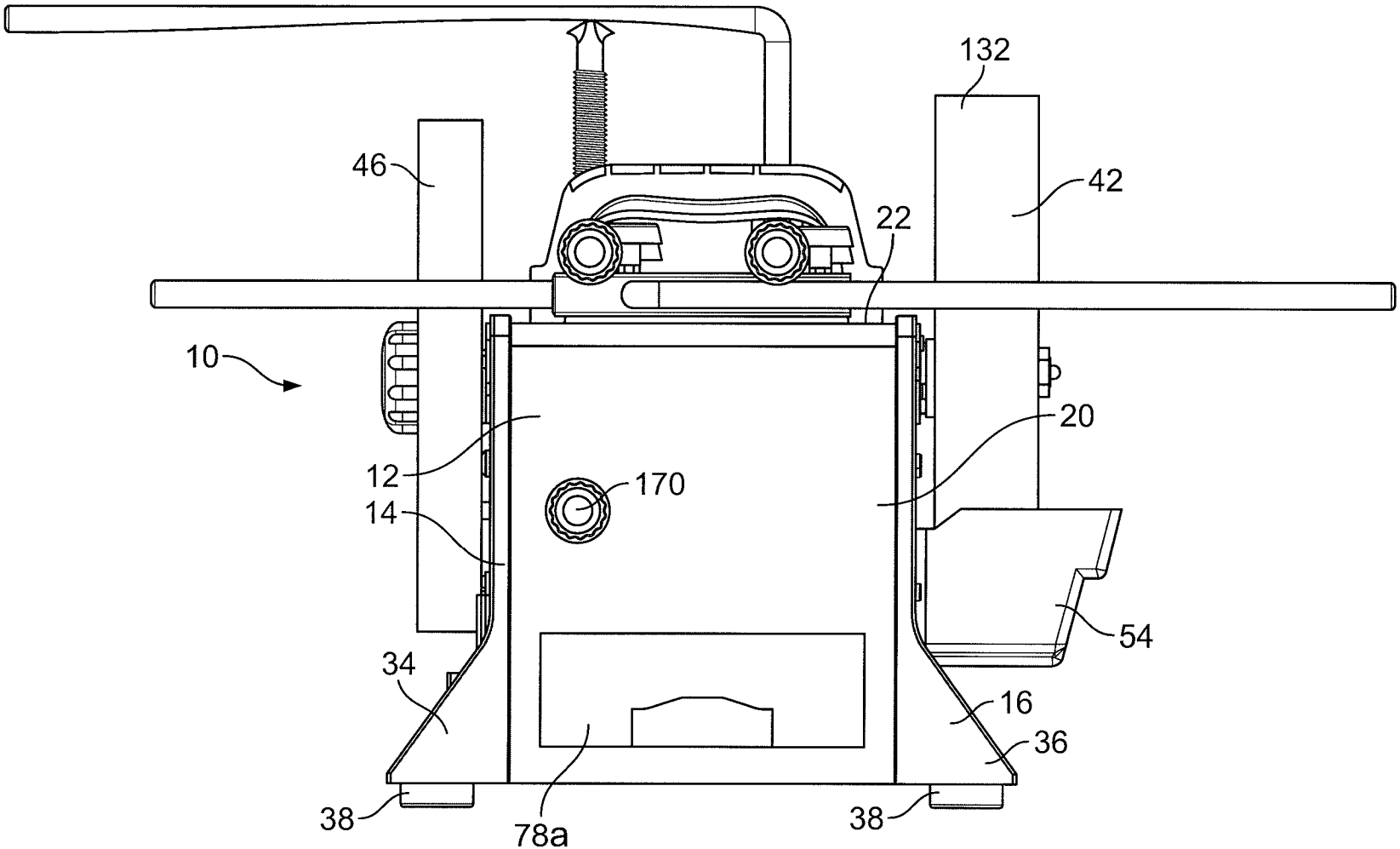
FIG. 3 is front elevational view of the wet sharpener of FIG. 1 without a base.

Referring to FIGS. 2 and 5, an alternative container design (shown in dashed line) adds a flared side wall 60 to the pan 54. In this embodiment, the flared side wall 60 acts as a splashguard for catching the coolant ejected from the container 54 or the grinding stone 42 and returning the coolant to the reservoir 54. The splashguard 60 also helps to provide a wider area for filling the reservoir 54. Another splashguard may be provided near the top of the sharpener 10 to also catch and return ejected coolant to the reservoir 54. For example, in the embodiment illustrated in FIG. 2, the splashguard 62 is bent upward and is mounted on the top panel 22 or the side panel 16 (or both) so that it wraps around a handle 64 on the top panel 22 in order to intercept coolant ejected from the grinding stone 42 and moving toward the top panel 22. The splashguard 62 has a cut-out 61 that receives the handle to avoid a hand-gripping portion 63 of the handle 64.

While the upper splashguard 62 is shown to be generally rectangular, it may have many other shapes including those that are more semi-circular in shape to more closely match the splash patterns from the wet grinding stone 42. The splashguard 60 may also have a variety of different shapes as long as it continues to catch and return ejected coolant to the reservoir of container 54.

The tool sharpener 10 also has three horizontally extending support bars 68 (also called the 'universal support') for holding the various accessories, such as jigs and supports, for the sharpening of tools (not shown). The support bars 68 are mounted on the top panel 22 of the housing 12 by using collars 70 and threaded fasteners 72 with gnarled knobs 74. In a preferred form, the support bars 68 are made of iron or other hard metals that can withstand the pressure placed on the bars 68 when accessories are used therewith to sharpen tools via sharpener 10.

Referring to FIGS. 4-5, the tool sharpener 10 has convenient storage spaces within the housing 12 and base 18 for storing the accessories used with the tool sharpener. For example, in the embodiment illustrated, the front panel 20 has an opening 76 for receiving a receptacle 78*a*, such as a drawer. The receptacle 78*a* slides along rails 80 (shown best in FIG. 4). The rails 80 are angle shaped and extend from the front panel 20 to the back panel 24. The receptacle 78*a* has a bottom wall 82, back wall 84 and two side walls 86 as well as a front wall 88 that has a hand-sized indent 90 to operate as a handle. Receptacle 78*a* also has a height that avoids interference with any of the mechanisms in the interior 48 of the housing. A leaf spring 92 (shown in FIG. 5) is mounted on the exterior of one of the side panels 86 so that the receptacle 78*a* fits snuggly within opening 76 of the front wall 20 in order to avoid unintentional opening of the receptacle.

Similarly, when a base 18 is provided, the interior 94 of the base 18 can hold at least one receptacle although a plurality of receptacles, such as drawers 78*b* and 78*c*, are preferred. The drawers 78*b* and 78*c* may have the same structure as receptacle 78*a* although the dimensions or structure of the receptacles may also be different, if desired. For example, alternate drawer members may have sliding rail members with bearings attached to the drawers in order to allow the drawers to open and close more easily when under load. In yet other forms, drawers of different shapes and sizes may be provided and/or drawers may extend from the sides or rear of base 18, rather than the front alone.

The base 18 is preferably formed by a back wall 96 (shown on FIG. 2), side walls 98, front wall 100, bottom wall 102 which the receptacles 78*b*, 78*c* rest upon, and top wall 104 that is sturdy enough to hold the tool sharpener when it is operating. Rails 106 extend inward from a vicinity of openings 108 on the front wall 100 of the base 18 that receive the receptacles 78*b*, 78*c*. The rails 106 are simply flat plates that sit upright on the bottom wall 102 of the base 18. As mentioned above, however, the rails 80 or 106 can be of any shape or structure that holds or guides the receptacles 78*a-c* while permitting the receptacles to slide through opening 76 or 108, respectively.

The receptacles 78*a-c* also have a downwardly extending tab 110 (shown in dashed line in FIG. 5) on the back wall 84 in order to hook onto the front wall 80 or 100 of the housing 12 or base 18 respectively in order to prevent unintentional full separation or removal of the receptacles 78*a-c* from the housing 12 or base 18.

It will be appreciated that the storage spaces within the interior 48, 94 of the housing 12 or base 18 can be configured to use receptacles of many different types. For instance, instead of the drawers, the interior storage spaces may have a permanent receptacle 78 that is accessible from the exterior of the tool sharpener by either an opening that remains open or selectively covered by any type of door, such as a hinged or sliding doors. The receptacle 78 may have its own walls or may not have any walls at all by simply relying on the walls of the housing 12 or base 18 to provide the enclosure for the implements to be placed in the storage area. Further, more than one drawer or receptacle may form a single storage space whether they are stacked or placed side by side or otherwise, and may be accessible through one or more openings on the housing 12 or base 18.

Referring to FIG. 2, the tool sharpener 10 can have an exterior receptacle 112 (shown in dashed line) with side walls 114, a back wall (not shown), and a bottom wall 116. At least one of the walls 114, 116 would be attached to an unused area on one of the panels 20, 22, 24, 26, 28, 96, 98 of the housing 12 or base 18. The receptacle 112 can be fastened or attached by welding, fasteners, hung by tabs, or any other method that secures the receptacle 112 to the tool sharpener 10. The receptacle 112 could have an open top 118 or any type of door or cover. The receptacle 112 could also sit upon or be secured to the top panel 104 or one of the sides 96, 98, 100 of the base 18.

It will further be appreciated that the side walls 114, bottom wall 116 or the back wall may be formed of a net, webbing or other apertured structure that holds accessories or tools by inserting the accessory or tool through a hole on one of the walls. The exterior storage receptacle 112 can be sized to hold one or more accessories or tools or even be configured to correspond to the shape of one or more of the accessories.

Figure 6:
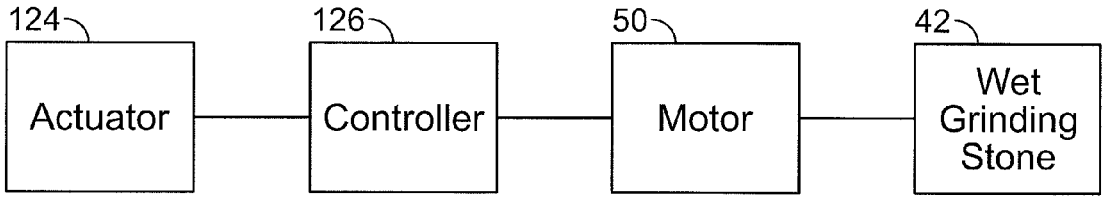
FIG. 6 is a block diagram of the variable speed control used in the wet sharpener of FIG. 1.
Figure 8:
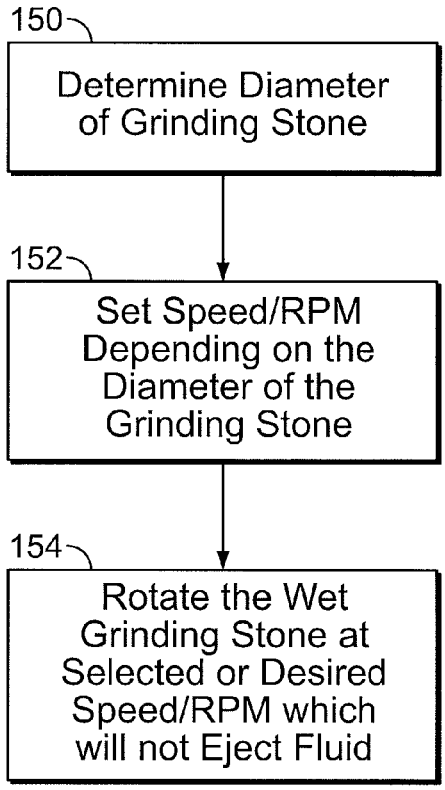
FIG. 8 is a flow chart for changing the speed of rotation or RPM of the wheels of the wet sharpener of FIG. 1.

Referring now to FIGS. 6-8, another aspect of the invention is a variable speed control that is provided with the tool sharpener 10 in order to change the rotation speed of the grinding stone 42. The variable speed is provided in order to compensate for a change in the diameter of the grinding stone 42 which occurs due to wear and which changes the contacting surface speed on the grinding stone. Thus, performance is enhanced and a constant level of aggression can be maintained by allowing the rotation speed to be changed to maintain a constant surface speed on the grinding stone 42.

Alternatively, the rotation speed may be increased to intentionally increase the grinding aggression. This has the effect of reducing the total time for sharpening a tool without requiring increased pressure or force to be applied to the tool. Thus, the user is able to select a speed which subjectively feels the most comfortable and/or the most efficient.

In one form, the variable speed control may be configured to provide a range of low speeds, such as for example speeds between approximately 50 to 150 RPM, which avoid significant ejection of the coolant from the reservoir 54 and the contacting surface or rim 132 of the grinding stone 42 in order to maintain the fluid level in the reservoir 54 and temperature of the contacting surface 132 within acceptable levels. In operation, the diameter of the grinding wheel 42 is measured to determine if the rotation (e.g., speed or RPM) of the wheel should be adjusted to avoid having the grinding wheel 42 rotate at too low a rate of speed/RPM or too high a rate of speed/RPM (Step 150 in FIG. 8). For example, if the diameter of the wheel has decreased to the point that the wheel is now spinning at too low of a rate of speed/RPM, an actuator 124, such as dial or knob 130 and potentiometer 142, may be adjusted to increase the speed/RPM of the grinding wheel 42 (Step 152 in FIG. 8). Once adjusted, the grinding stone 42 will be operated at the desired or selected speed/RPM set by the actuator 124 (Step 154 of FIG. 8).

In the embodiment illustrated in FIGS. 2 and 5, the actuator 124 extends out from the back panel 24 of the housing 12 so that the actuator may be rotated between a plurality of different positions, each corresponding to a different rate of speed or RPM for the motor output shaft, and in turn the grinding stone 42 connected thereto. More specifically, the input shaft of potentiometer 142 extends out of a back plate or back face 134 of control box 128 and is connected to knob or dial 130 which an operator may use to rotate the potentiometer 142 about the plurality of different positions. In one form, the knob 130 may have a grip to aid the user in operating the actuator 124. For example, the knob 130 may include knurling, textured surfaces, overmolding (such as an elastomer injected overmolding), rubber coatings or layers, or the like, which assist the user in gripping and turning the actuator 124. Although not discussed in detail above, the other threaded fasteners discussed herein in connection with sharpener 10 may also include such grips to assist the operator in tightening or releasing the fasteners.

In the embodiment illustrated, indicia 136 is displayed on the back face 134 of sharpener 10 in the vicinity of the dial 130 so that dial 130 can be rotated to a predetermined position to select a desired setting within a range of possible settings. The indicia 136 may display speed, RPMs, corresponding grinding stone diameters, or any combination or one of these. For example, the indicia may provide a scale identifying different predetermined speed/RPM settings which are desired for certain grinding stone diameters (Step 152 in FIG. 8). In a preferred form, the indicia displays a scale with the following five demarcations or settings: 90 RPM/10" Diameter; 105 RPM/9" Diameter; 120 RPM/8" Diameter; 135 RPM/7" Diameter; 150 RPM/6" Diameter. These settings are merely exemplary, however, and may vary according to application. For example, alternate sharpeners 10 may include these RPM/Diameter settings for a first grinding stone and a second set of settings (or a second scale) for use with a different grinding stone, such as when the first grinding stone is replaced with a grinding stone of different texture, coarseness or grit. In yet other embodiments, the indicia may provide a scale or scales with different alpha/numerical indicia (e.g., speed, RPM, diameter, etc.) that have been selected for specific applications.

The actuator 124 may also include a pointer or needle 146 (FIGS. 2 and 5) which rotates with the knob or dial 130 in order to indicate the actuator's position with respect to the indicia 136 and/or the sharpener housing 12. For example, in the embodiment illustrated, the sharpener 50 includes a pointer 146 which is connected to the dial 130 via a fastener or fasteners, such as set screws (not shown), and extends out from the knob 130 and tracks the scale created by the indicia 136. In other embodiments, the pointer 146 may be integral to the knob or dial 130, to reduce the number of pieces required for the actuator 124. For example, the knob 130 may be molded out of plastic and include an integral pointer such as a raised protrusion or line which the operator may use to track the knob's position with respect to the indicia 136 and/or the sharpener housing 12.

In yet other embodiments, the location of the indicia 136 and pointer 146 may be reversed so that the knob or dial 130 includes indicia and the tool sharpener housing 12 includes a pointer. With this configuration, the operator may track the position of the actuator and select the desired motor speed/RPM by rotating the actuator until the indicia on the knob 130 lines up with the pointer on the tool sharpener housing. In still other forms, both the knob 130 and housing 12 may contain indicia which the operator may use to track the actuator's position and/or set the desired motor speed/RPM.

In the embodiment illustrated, the actuator 124 may be rotated about its axis approximately three-hundred fifty degrees (350°), with most (if not all) increments corresponding to a change in motor speed or RPM. As mentioned above, however, the preferred indicia will not attempt to track every possible setting of the actuator or motor speed/RPM, but rather will attempt to mark relevant settings that help the user in adjusting the rotation of the grinding stone 42 when needed. For example, in the embodiment discussed above, the five demarcations mentioned were selected because they represent a preferred change in speed/RPM based on various grinding stone diameters. The scale selected illustrates the desired speed/RPM each time the diameter of the grinding stone is reduced by an inch. For example, the first setting on the scale identifies the desired speed/RPM when the grinding stone is ten inches (10") in diameter. The next setting identifies the desired speed/RPM when the grinding stone is nine inches (9") in diameter. The next setting identifies the desired speed/RPM when the grinding stone is eight inches (8") in diameter. The next setting identifies the desired speed/RPM when the grinding stone is seven inches (7") in diameter. The final setting identifies the desired speed/RPM when the grinding stone is six inches (6") in diameter.

Although the preferred scale uses one inch diameter increments, it should be understood, that this scale provides users with sufficient information to adjust the tool sharpener 10 to operate at other desired speeds/RPMs. For example, if the user determines that the diameter of the grinding stone is nine and a half inches (9.5"), the scale allows the user to rotate the actuator 124 until the pointer 146 is positioned between the settings for ten inch (10") and nine inch (9") diameters. Furthermore, as mentioned above, a number of different scales may be used for the indicia 136. For example, the indicia may identify desired increments of speed/RPM rather than grinding stone diameter. In yet other embodiments, the indicia may identify the desired speed/RPM for different metals that the grinding stone 42 will be used on. For example, different speeds/RPMs (or ranges of speeds/RPMs) may be provided for tools made of softer metals than for tools made of harder metals.

In other embodiments, the actuator 124 may only adjust the speed/RPM when predetermined positions are reached, rather than continuously adjusting the speed/RPM as the actuator 124 is rotated. For example, rotation of the actuator between a first predetermined position to a second predetermined position may not cause a change in the speed/RPM until the second predetermined position is reached. This may be accomplished by programming a controller, such as an integrated circuit ("IC"), to determine the input from an actuator, such as a potentiometer, and maintain the current motor speed until predetermined inputs or changes in input are reached.

In still other embodiments, the tool sharpener 10 may be provided with an actuator 124 that has positive stops at predetermined intervals which allow the user to easily adjust the speed/RPM from one setting to another without concern that the desired speed has been exactly reached. For example, a ball and detent configuration may be used which allows the actuator 124 to snap into a predetermined position once a desired speed/RPM has been reached. In cases such as this, where a plurality of different desired settings (e.g., speed, RPM, etc.) positions may exist, the actuator may be designed to have a plurality of positions wherein the actuator 124 snaps into position via the ball and detent configuration.

As shown in FIG. 6, the variable speed control may include an actuator 124 connected to a controller 126, which together allow an operator to alter the speed/RPM of the motor output shaft to control the speed/RPM of the wet grinding stone 42. In a preferred form, the controller 126 may be in the form of an electronic circuit 138 such as that shown in FIG. 7A. In this circuit, the actuator 124 is a potentiometer 142 which serves as the input by which the operator may manually adjust the speed/RPM of the motor output shaft. The controller 126 is preferably an integrated circuit, such as IC 144, which is connected to the potentiometer 142 and reads the potentiometer setting to determine what speed/RPM the motor output shaft should be operated at and to drive the motor output shaft at the desired speed/RPM.

Although the circuit illustrates the actuator 124 as a potentiometer or rheostat and the controller as an IC, it should be understood that alternate components may be used to perform the same function. For example, the actuator 124 may be in the form of a multiple position switch capable of varying the speed/RPM of the motor output shaft. Similarly, the controller may be in the form of a different type of processor or logic control, such as for example a programmable logic controller, microprocessor or other micro-controller, or simply individual logic components.

Figure 7A:
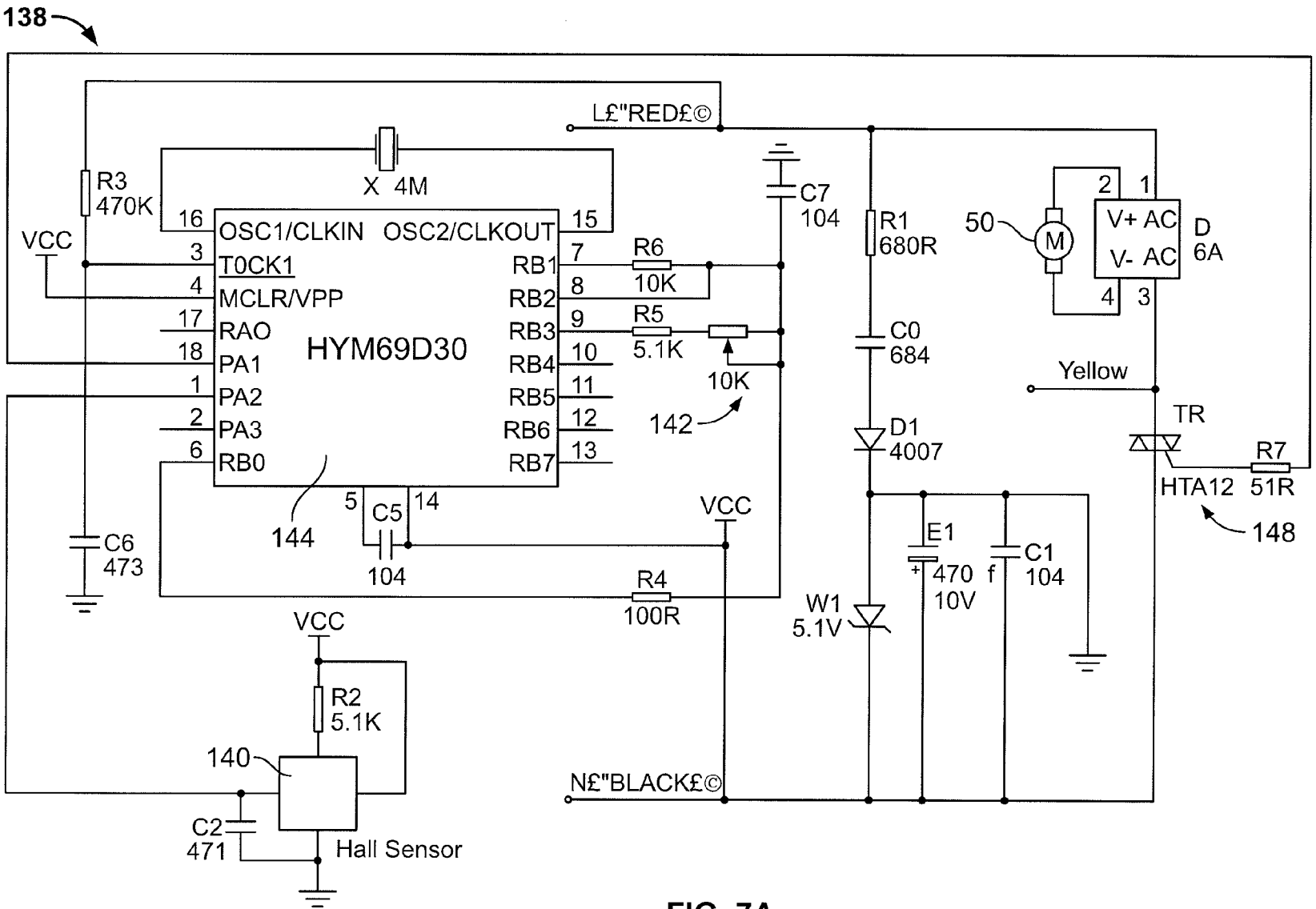
FIG. 7A is a circuit diagram of a variable speed control circuit for the wet sharpener of FIG. 1.
Figure 7B:
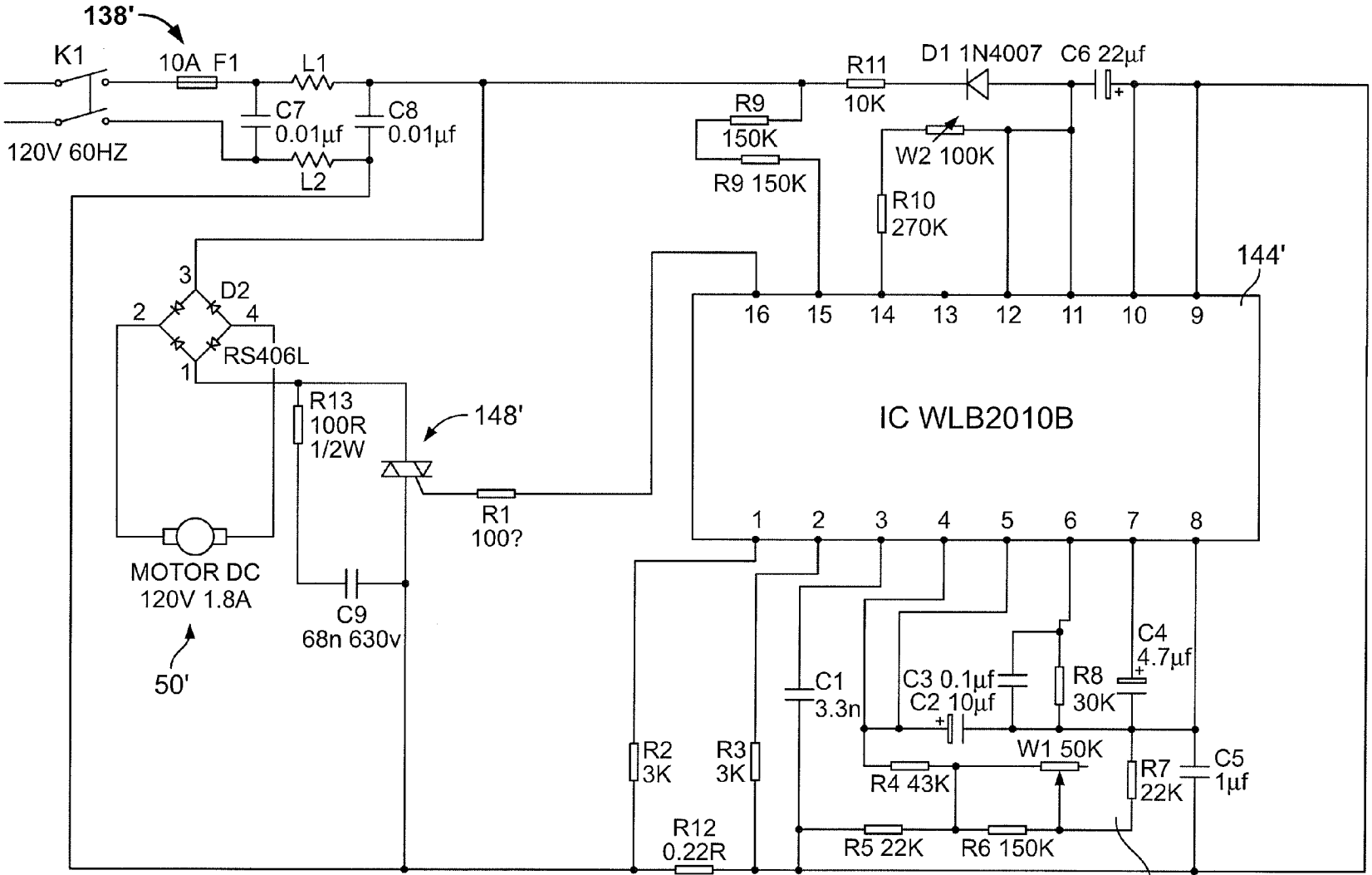
FIG. 7B is an alternative circuit diagram of a variable speed control circuit for the wet sharpener of FIG. 1.

In FIG. 7A, AC power is converted to DC power via a rectifier (not shown), and supplied to the electronic circuit. When the potentiometer 142 is adjusted, the input signal supplied to the IC 144 via pin 9 (RB3) is altered, which indicates to the IC 144 how much power should be applied to motor 50 via the electronic switch 148 connected to output pin 18 (PA1) in order to drive the motor output shaft at the desired speed/RPM. More particularly, IC 142 applies an output, such as a potential (e.g., voltage), to two terminals of the potentiometer 142 and reads the input from the third terminal of the potentiometer via pin 9 (RB3) to determine the current setting of the knob or dial 130. When the operator rotates the knob or dial 130, the resistance of the potentiometer 142 changes thereby changing the input signal (e.g., voltage) at pin 9 (RB3) of the IC 144. The IC 142 then applies a corresponding output, such as voltage, to the gate of triac 148 thereby turning on the motor and driving the motor out put shaft at the desired speed/RPM.

In a preferred form, the variable speed control may also include a sensor for monitoring the speed of the motor output shaft and/or the grinding stone 42 connected thereto. This sensor allows the IC to ensure that the circuit 138 is operating correctly and that the motor output shaft is being driven at the desired or selected speed/RPM. For example, in circuit 138, a magnetic sensor, such as Hall Effect sensor 140, is connected to the IC 144 and the motor output shaft to calculate the actual speed/RPM of the motor output shaft. It should be understood, however, that such a sensor is merely an optional feature and need not be part of the variable speed control if desired. For example, in FIG. 7B, an alternate circuit 138' is shown that operates without a Hall Effect feedback sensor. Otherwise, all common items on circuit 138' are numbered similarly to items shown on circuit 138 (FIG. 7A) except with a prime symbol.

It should also be understood that, although a magnetic hall effect sensor 140 is illustrated in FIG. 7A, alternate embodiments of the variable speed control may use other types of sensors, such as optical sensors (e.g., optical pairs, photodiodes and transistors, etc.) and other pulse generators to determine the actual speed/RPM of the motor output shaft and/or the wheel being driven thereby.

Referring again to FIG. 6, when the controller 126 changes the motor output shaft's rotational speed/RPM, it is changing the rotation speed/RPM of the drive shaft 52 which rotates the drive hub 43 and axle 44 connected thereto, which in turn rotates the honing wheel 46 and wet grinding stone 42 connected to the axle 44. In the embodiment illustrated, the drive hub 43 has a disc like shape with an outer surface 186 for frictionally engaging the drive shaft 52 of motor 50. More particularly, the drive hub 43 has a rubber outer layer 43*a* that extends about the circumference of an inner plastic body or disc 43*b* and grips the drive shaft 52 to rotate when driven by the rotating shaft 52. This configuration allows the motor 50 to drive the axle 44 via a frictional engagement configuration which allows the drive hub 43 (and axle 44 connected thereto) to slip and stop rotating if an excessive amount of force or friction is applied to either the honing wheel 46 and grinding wheel 42. This configuration and slipping capability can prevent damage to the motor 50 and/or the tool being sharpened due to excessive forces or friction being applied to the tool.

It will be appreciated that many other configurations for the actuator 124 exist other than the dial 130 such as a key pad for typing in the desired speed, or other types of inputs or switches such as slides or buttons indicating selected speeds, whether predetermined or not. It will also be appreciated that the speed controller 126 could be programmed to change the rotation speed of the grinding stone 42 on its own if it received a signal that automatically detected a change in diameter or speed/RPM of the grinding stone 42. For example, automatic detection of the grinding stone diameter could be accomplished via a variety of optical sensors, such as for example, optical pairs, photo diodes and transistors, infrared ("IR") sensors, fiber optic sensors, or other optoelectronic sensors, ultrasonic sensors, or other presence/absence sensors. In one form, the tool sharpener 10 may be provided with multiple photo transistors/diodes connected to the controller 126 and spaced such that one photo transistor is switched on when the grinding stone diameter reaches nine inches (9") in diameter, another photo transistor turns on when the grinding stone diameter reaches eight inches (8") in diameter, and so on. Upon the detection of each transistor being turned on, the IC may be programmed to automatically adjust the speed/RPM of the motor output shaft to account for the change in the diameter of the grinding stone 42.

In yet another form, the tool sharpener 10 may use a combination of feedback sensors to determine whether or not the grinding stone is operating as desired and allowing the IC to take corrective action if it is not. For example, if the optical feedback sensors indicate that the diameter of grinding stone has reached a predetermined smaller diameter and the magnetic Hall Effect feedback sensor indicates that the grinding stone 42 is not rotating at a desired speed/RPM, then the IC 144 may be programmed to take corrective action to compensate for this feedback or data. Thus, it should be clear that feedback sensors may be utilized in a variety of ways in conjunction with the tool sharpener 10.

Figure 9A:
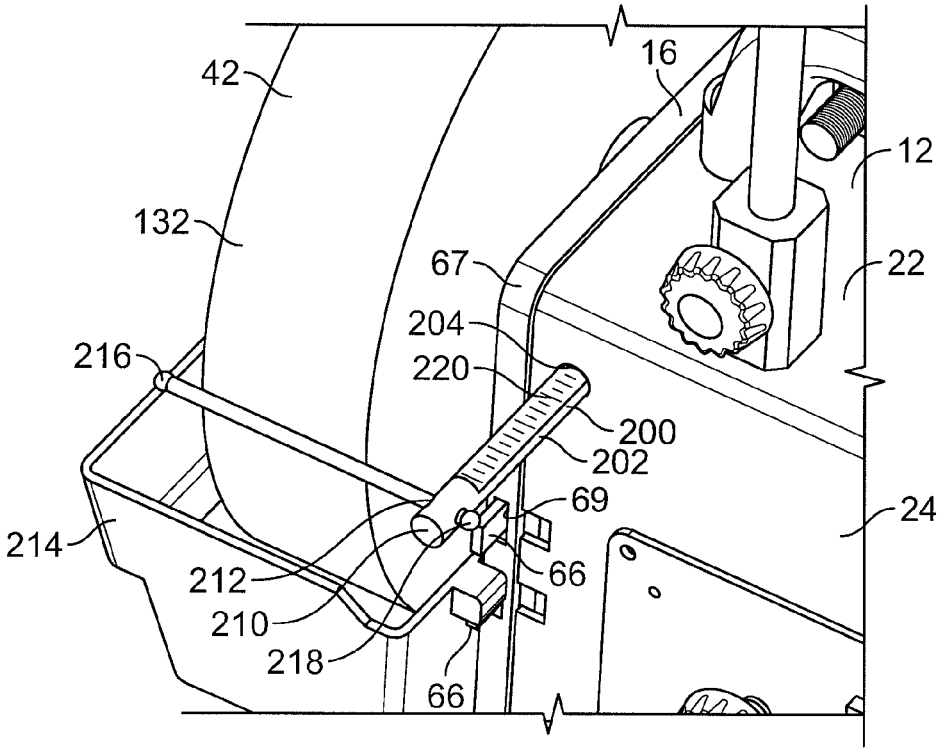
FIG. 9A is an enlarged, rear perspective view of the wet sharpener of FIG. 1 with the wheel-diameter gauge in a first position.
Figure 9B:
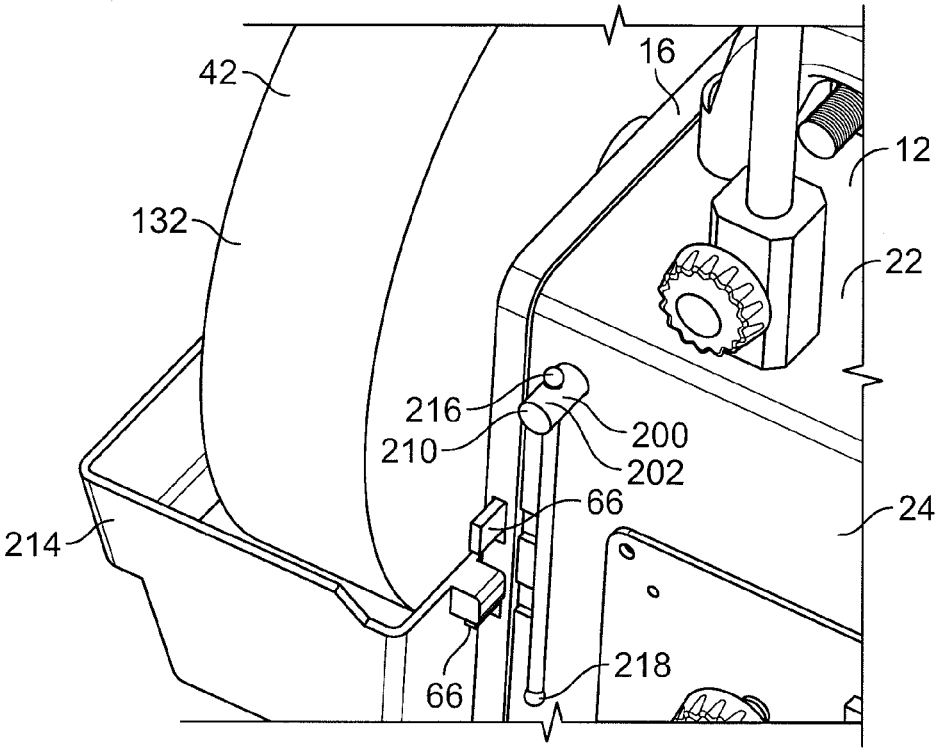
FIG. 9B another enlarged, rear perspective, partial view of the wet sharpener of FIG. 1 with the wheel-diameter gauge in a second position.
Figure 9C:
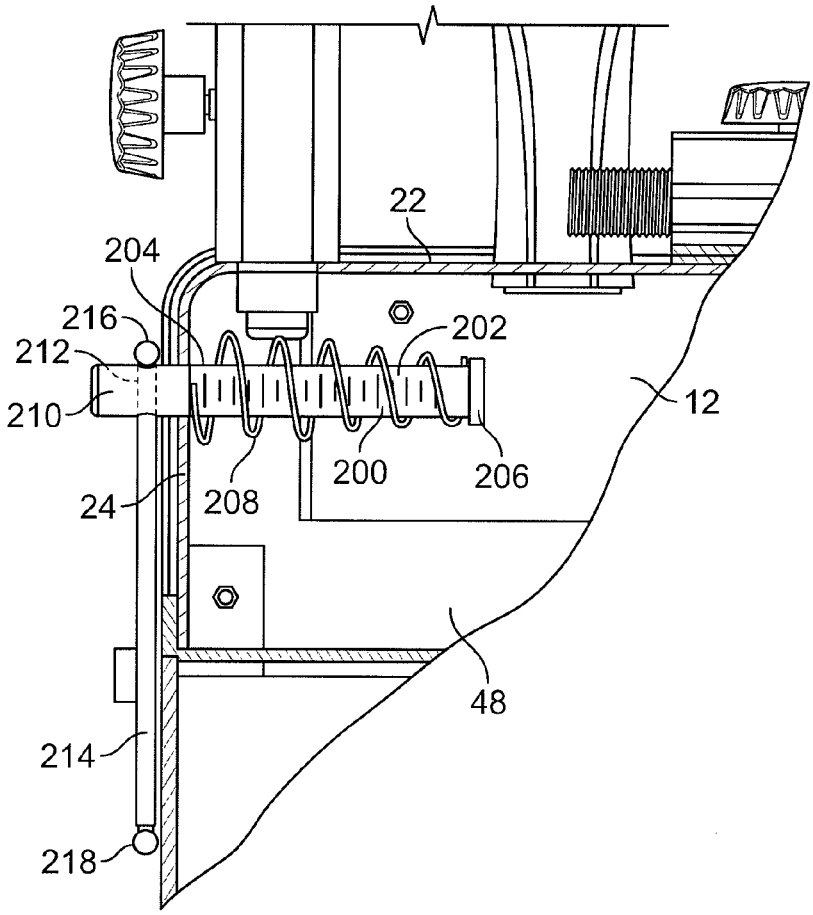
FIG. 9C is a side, cross-sectional view of a portion of the wet sharpener of FIG. 1 showing the wheel-diameter gauge.

In the manual grinding stone diameter detection method illustrated in FIGS. 9A-9C, however, a diameter gauge 200 is provided as one example mechanism for manually measuring the diameter of the grinding stone 42. The diameter gauge 200 has a gauge member 202 mounted through a hole 204 on the back panel 24 of the housing 12. As shown in FIG. 9C, the gauge member 202 has a widened proximal end 206 extending within the interior 48 of the housing 12 and a biasing member 208 such as a helical spring extending between the widened head 206 and the back panel 24 to bias the diameter gauge 200 in a retracted position within the housing 12. The gauge member 202 is positioned approximately the same height as the axle 44 in order to extend along the radius of the grinding stone 42 since the axle generally defines the axis of rotation for the grinding stone 42 as shown on FIG. 4. It will be appreciated that the gauge member 202 could be placed higher or lower than this as long as the gauge provided an indication of diameter positioned on the gauge depending on a calculation that factors the distance between the gauge's position and the radius of the grinding stone.

The proximal end 210 of the gauge member 202 has a through-hole 212 that receives an elongated stop 214 with enlarged longitudinal ends 216, 218. The through-hole 212 and stop 214 are sized so that the stop is free to translate axially within the through-hole 212, similar to that of a slotted T-handle found on a vise or clamp. The enlarged ends 216, 218 secure the stop 214 to the distal end 210. It should be understood, however, that in alternate embodiments the stop 214 need not be movable with respect to the through-hole 212 so long as it can be rotated into and out of engagement with the grinding stone 42.

When stored or placed in its stored position (as shown in FIG. 9B), the gauge member 202 is retracted into the housing 12 and the stop 214 rests against the back panel 24, across the hole 204 on the back panel, and prevents the gauge member from being completely drawn into the housing 12. Conversely, when in use (as shown in FIG. 9A), gauge member 202 is pulled out of the housing 12 and the stop 214 is swung around or pushed axially in front of the outer rim 132 of the grinding stone 42. An array of indicia 220, such as a scale, is disposed along the length of the guiding member 202 indicating the diameter of the grinding stone 42 by the indicia that is disposed at the hole 204 on the back panel 24, or more specifically, the indicia intersecting a plane defined by the hole 204. After measurement, the elongated stop or rod 214 can simply be pushed back axially or rotated, which rotates the gauge member 202 in the hole 204, to remove the gauge 200 out of the way of the rotating outer rim 132.

In yet other embodiments, the gauge member 202 may be designed to completely retract into the housing 12 or retract sufficiently so that the distal end 210 is flush with the back panel 24. The gauge 202 could then be configured so that by either pushing on the distal end 210 or actuating another mechanism would eject at least a portion of the gauge member 202 out of the housing 12 so that the user could pull the gauge further out of the housing and measure the diameter of the grinding stone 42. For example, the gauge member 202 could be designed so that by pushing the distal end 210 in toward the interior of the housing 12, the gauge member 202 would be slightly popped out of the housing leaving a portion of the gauge member 202 exposed so that the user could pull the gauge member 202 out of the housing 12 and rotated into contact with the grinding stone 42. Then, as mentioned above, the biasing mechanism 208 would position the stop 214 against the stone so that an accurate diameter reading may be made.

Figure 10:
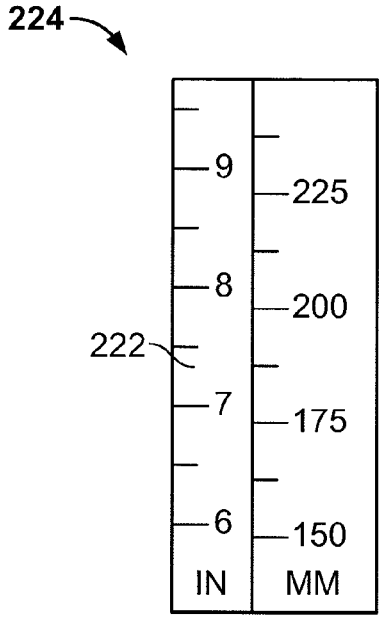
FIG. 10 is a front view of a diameter scale for the wet sharpener of FIG. 1.

It will be appreciated that many other ways exist for measuring the diameter of the grinding stone or wheel 42 such as using indicia 222 displayed on the top panel 22 of the housing 12 and next to the outer rim 132 of the grinding stone 42 (as shown in FIG. 1). For example, as shown in FIG. 10, the indicia 222 may be provided on a decal 224 that is adhered or otherwise secured to the top of the housing 12. In the form illustrated, the indicia 222 provides a scale in both inches and millimeters (although other scales of measurement may be used). Of course, although more cumbersome and not as accurate, the grounding stone 42 could simply be measured by hand, by a ruler, or other separate device, as well.

Figure 11:
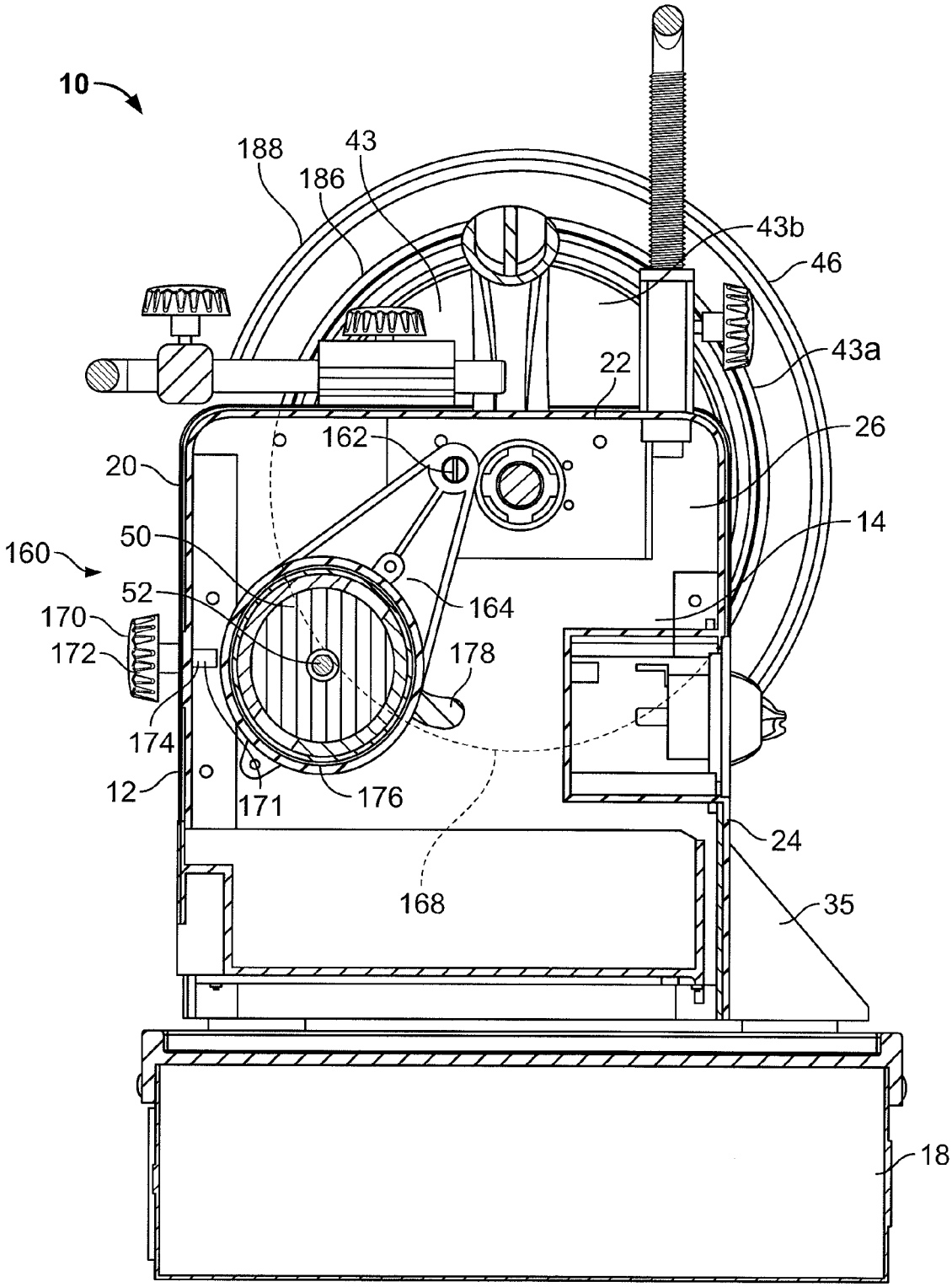
FIG. 11 is a right side, cross-sectional view of the wet sharpener of FIG. 1.
Figure 12:
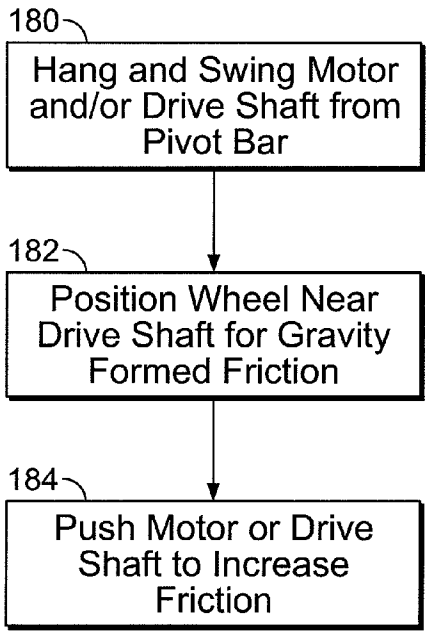
FIG. 12 is a flow chart for adjusting the friction against the wheel on the wet sharpener of FIG. 1.

With reference to FIGS. 11-12, a friction adjustment device 160 is provided that adjusts the friction between the drive shaft 52 of the motor 50 and the honing wheel 46 in order to compensate for slipping between the two caused by undesirable debris or wear on the honing wheel 46 or the drive shaft 52. The motor 50 hangs on a pivot bar 162 that extends from, and is mounted on, the two sidewalls 14 and 16. Two hangers 164 and 166 (shown in FIGS. 4 and 5) are pivotally mounted on the pivot bar 162 and are attached to the motor 50 so that the motor, and in turn the drive shaft 52, is free to swing about the pivot bar (Step 180 on FIG. 12). The drive shaft 52 is also free to swing within a slot 178 on the side panel 26 (shown best in FIG. 5) so that it can contact the honing wheel 46.

In alternate embodiments, the motor 50 may be configured to either directly drive axle 44, such as by way of a geared transmission, in lieu of the frictional engagement configuration discussed above, or by way of a belt driven system. For example, in one form, the motor output shaft may be connected to a drive gear that drives a gear or gears connected to axle 44. In other forms, the motor output shaft may drive a hub connected to a belt, such as a V-belt, which in turns drives a hub connected to axle 44.

In place of or in addition to the friction adjustment device 160, alternate embodiments of the tool sharpener 10, such as those using a belt drive, may also include a tension adjustment mechanism which allows tension between the motor output shaft 52 and the member or members driven by the motor output shaft 52 to be tightened and/or released in order to ensure that the operation of the motor 50 provides the desired rotation of the honing wheel 46 and/or grinding stone 42 in any particular application. For example, in the belt driven system discussed above, the motor 50 may be connected to a screw drive which allows the motor to be moved in one general direction to increase the amount of tension applied to the V-belt by the hub connected to the motor 50 and in a generally opposite direction to reduce the amount of tension applied to the V-belt by the hub connected to the motor 50. In yet other forms, a tension adjusting mechanism such as a screw drive may move the axle 44 and hub associated therewith.

In the embodiment shown in FIGS. 11-12, the honing wheel 46 has an inner rim 168 relative to the contacting surface or outer rim 188 of the honing wheel. The inner rim 168 is formed by, in this example, the outer surface 186 of the hub 43 of the honing wheel 46. The inner rim 168 faces away form the axle 44 (i.e., and its axis of rotation) so that as the motor 50 swings about pivot bar 162 downward due to gravity (referred to herein as being included in a 'first' force), the drive shaft 52 abuts the lower rim 168 as shown in FIG. 11 (Step 182 on FIG. 12). Thus, friction created between the drive shaft 52 and the lower rim 168 rotates the honing wheel 46, and in turn the grinding stone 42. This configuration permits the motor 50 and driveshaft 52 to temporarily separate from the honing wheel 46 when the wheels 42, 46 are overloaded which prevents damage to motor 50.

In order to compensate for an undesirable reduction in friction, the friction adjustment device 160 adds a second force, in addition to the first force caused by gravity, that acts upon the drive shaft 52 to ensure an adequate amount of friction exists between the drive shaft 52 and inner rim 168. To accomplish this, the friction adjustment device 160, at a minimum, includes an actuator 170 with a member 171 that extends in the interior 48 of the housing 12 and toward at least either the motor 50 or the drive shaft 52.

The member 171 engages the motor 50 or drive shaft 52, temporarily or permanently, so that driving the member in a direction that pushes the motor 50 and/or the drive shaft 52 toward the outer rim 168 of the honing wheel 46 creates the second force applied against the drive shaft (Step 184 on FIG. 12). Although not shown, it will be appreciated that the member 171 could contact the drive shaft 52 if the drive shaft had a non-rotating sleeve or any other non-rotating structure or the member 171 may have a tip made of a low friction material or structure that pushes the drive shaft 52 radially without creating significant circumferential friction on the drive shaft 52.

The actuator 170, in one example, includes a gnarled knob 172 mounted on the exterior of the front panel 20 of the housing 12 and is attached to a threaded shank 174 that forms the member 171. The shank 174 is threaded directly to the front panel 20 for extending through the front panel 20 and into the interior of housing 12 so that it points toward the motor 50. Upon rotation of the knob 172, the shank 174 is driven axially and farther into the interior 48 of the housing 12 so that it abuts (if it isn't already), and presses horizontally against, the outer surface 176 of the motor 50 and forms the second force against the drive shaft 52 to increase the friction between the drive shaft 52 and outer rim 168 of the honing wheel 46.

It will be appreciated that other configurations for the actuator 170 and member 171 exist other than a knob or screw including any kind of configuration with levers, slides, switches, cams or any other mechanical device that will move the motor 50 and drive shaft 52 towards the inner rim 168 of the honing wheel 46. It will also be appreciated that the member 171 could move in other directions other than horizontal to create the second force (i.e., it could be slanted or even move vertically against a cylindrical motor body for instance).

It will also be appreciated that alternative embodiments exist where the drive shaft 52 directly contacts the contacting surface 188 of the honing wheel or where the inner rim 168 faces inward instead of outward on hub 43 and the drive shaft is urged radially outward and against the inner rim 168 by gravity or other mechanically or magnetically created forces. It will also be understood that the drive shaft 52 may not directly contact the honing wheel when intermediary pieces such as wheels, gears, or additional shafts or even coatings, layers, or concentric pieces such as collars are used on either the honing wheel or the end of the drive shaft to further control the friction between the honing wheel and the drive shaft. In still other embodiments, and as mentioned above, the drive shaft 52 may directly drive the grinding stone 42 or axel 44 rather than the honing wheel 46 and, thus, these drive embodiments and friction adjustment mechanisms may be applied to the grinding stone 42 or axel 44 instead of the honing wheel 46 in certain embodiments.

Figure 13A:
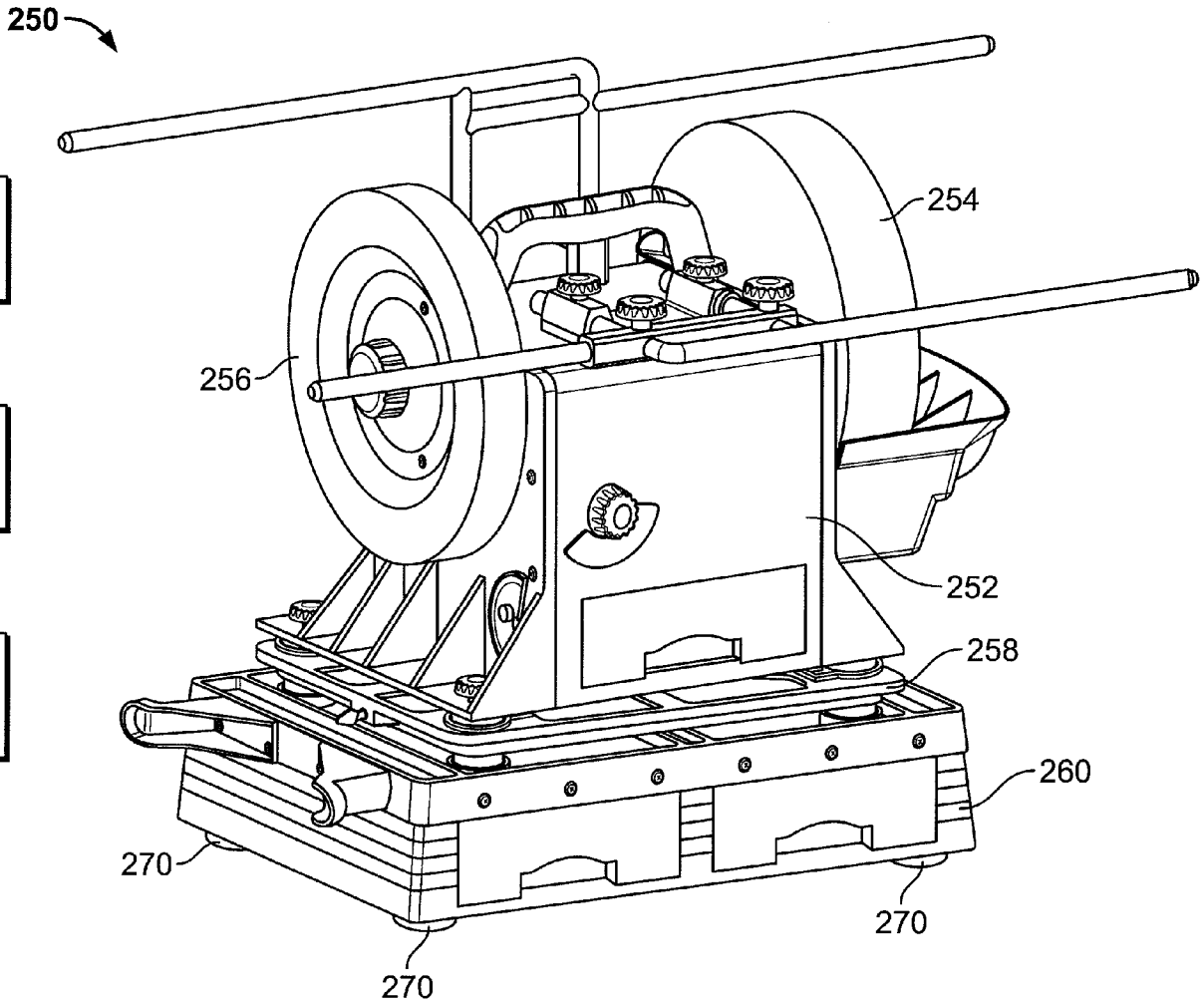
FIG. 13A is a perspective view of a pivoting wet sharpener.

Referring to FIGS. 13A-13E, an alternative wet sharpener 250 has a housing 252 positioned between a grinding stone 254 and a honing wheel 256, similar to the wet sharpener 10 as shown in FIGS. 1-5. The housing 252, the stone 254, and the wheel 256 are all mounted on a rotating base, such as pivot table 258, so that the grinding stone 254 and the honing wheel 256 may be pivoted to a convenient orientation relative to a work table or other surface the wet sharpener 250 is placed upon. The pivot table 258 may also be placed on a base or pedestal 260 as shown in FIG. 13A with storage spaces similar to base 18 of the wet sharpener 10.

Figure 13B:
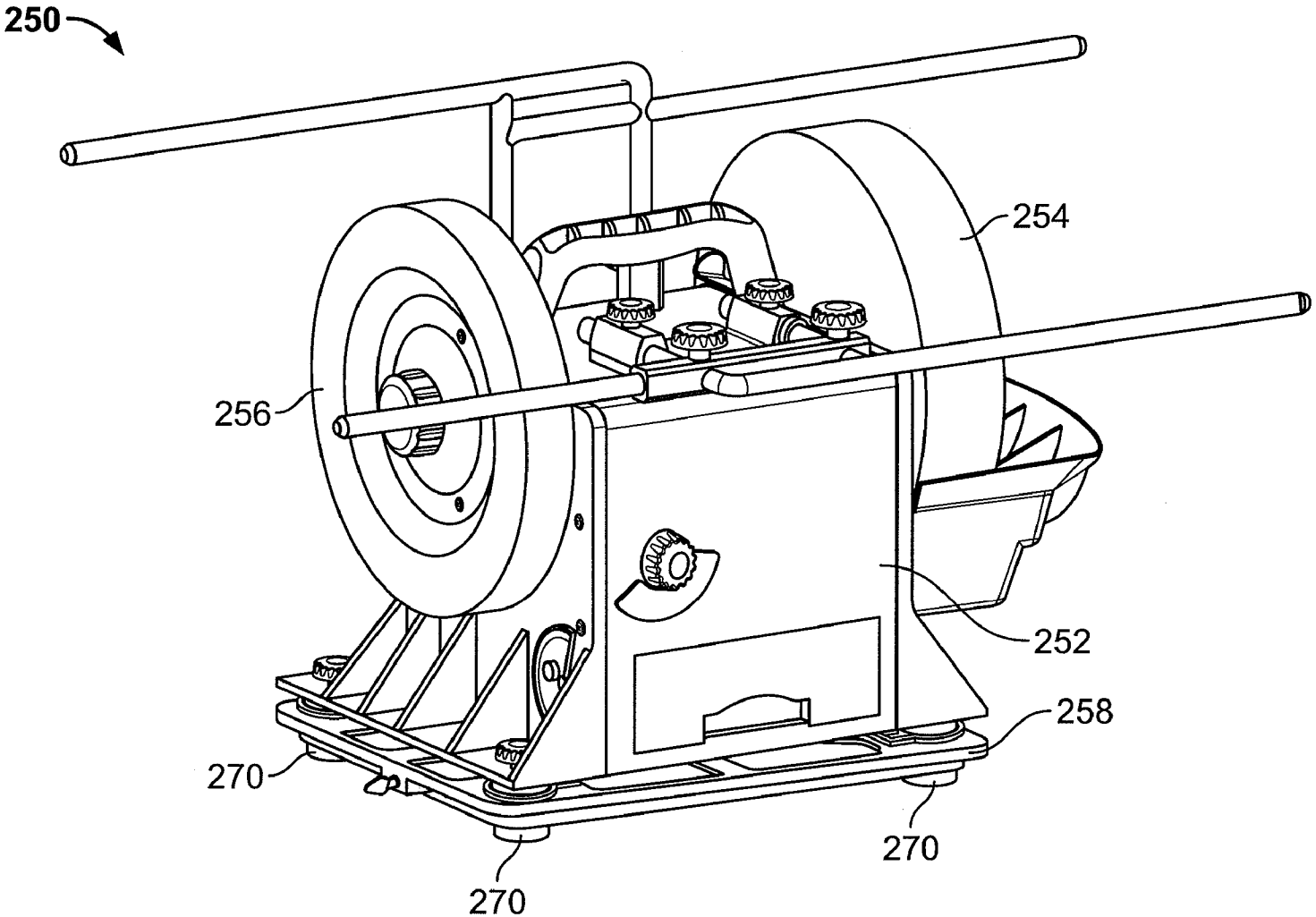
FIG. 13B is a perspective view of a pivoting wet sharpener without a base.
Figure 13C:
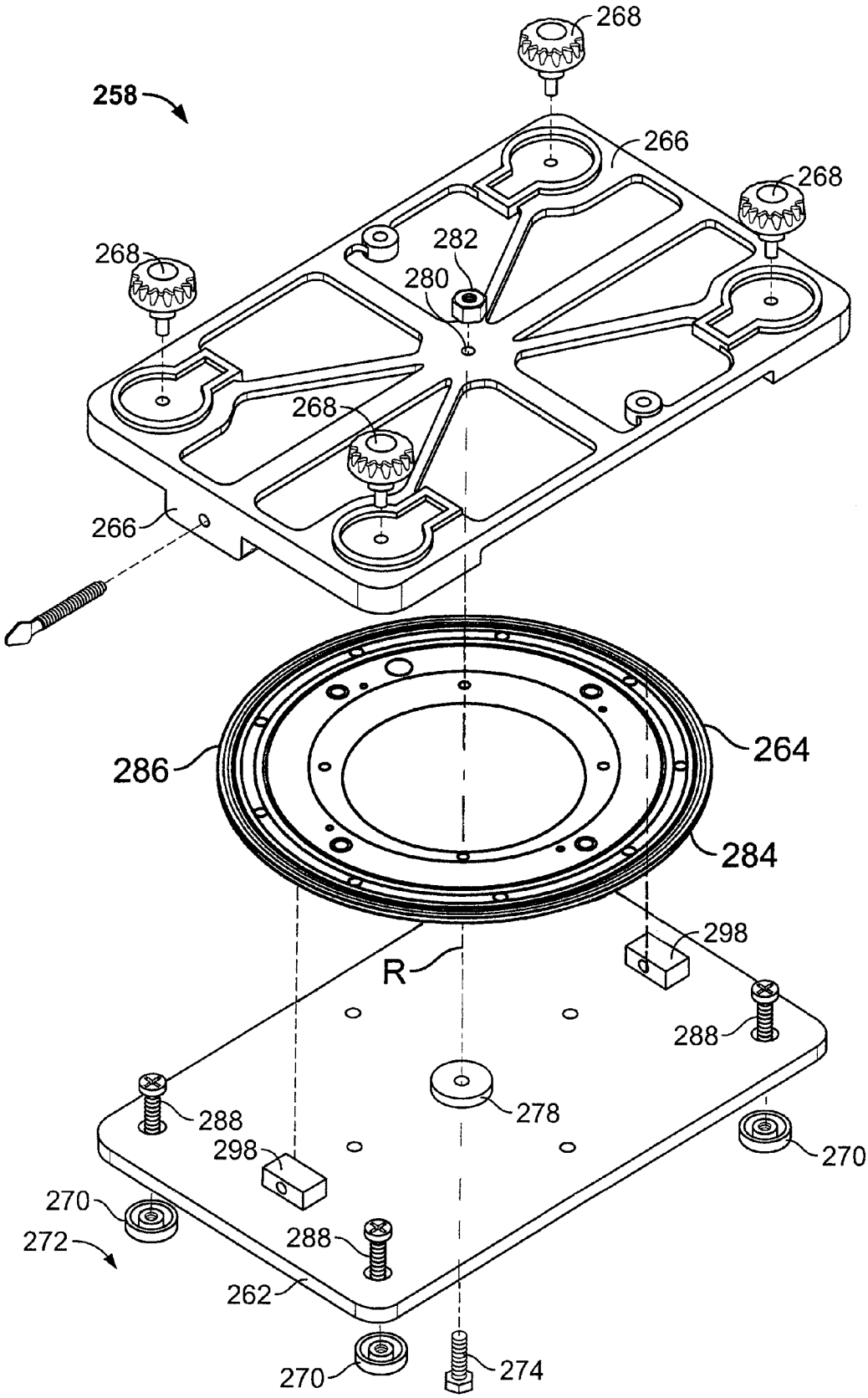
FIG. 13C is an exploded perspective view of a pivot table of the wet sharpener of FIGS. 13A-13B.
Figure 13D:
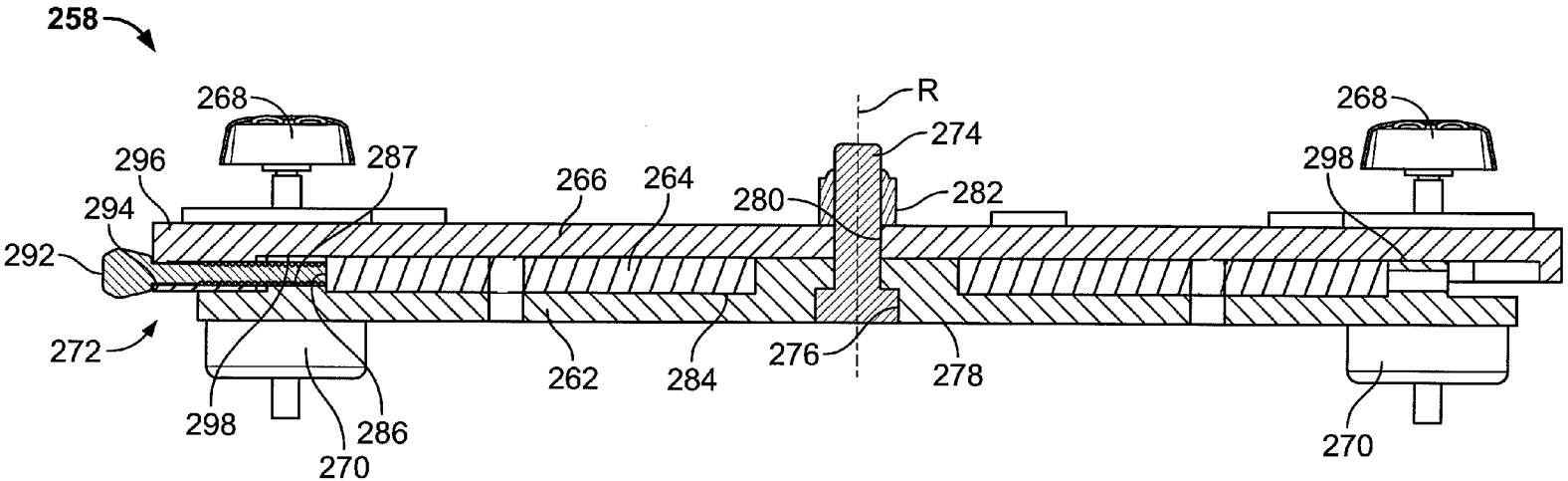
FIG. 13D is a cross-sectional, side view of the pivot table of FIG. 13C.

As illustrated in FIGS. 13C-13D, the pivot table 258 has a lower portion such as a lower plate 262, a support portion such as an annular disc 264 and an upper portion such as an upper plate 266. The upper plate 266 is rotatably mounted on the disc 264 which in turn is mounted on, and secured to, the lower plate 262. In the form illustrated, fasteners, such as screws or bolts, are inserted into the bottom of lower plate 262 through bores and thread into corresponding threaded bores located in the disc 264.

In the embodiment illustrated, the upper and lower plates 262 and 266 are generally rectangular to match the generally rectangular outer periphery of the wet sharpener 250 to avoid unnecessary extensions beyond the sharpener that might interfere with the manipulation of the accessories used with the sharpener or a user's desired position while operating the sharpener. It should be understood, however, that the pivot table 258 could have an outer periphery with a circular shape or other shapes, if desired.

Four fasteners 268, similar to fasteners 40 on wet sharpener 10, secure the housing 252 to the top of the upper plate 266. The pivot table 252 also has four feet 270 secured by counter-sunk screws 288 to the lower plate 262 for support. The counter-sunk screws 288 may be extended beyond the bottom of the feet 270 to connect to the base 260 if desired and as explained above for fasteners 40. A locking mechanism 272 secures the upper plate 266 in any rotated orientation relative to the lower plate 264.

In more detail, the upper plate 266 is secured to the lower plate 262 by a fastener 274 that, in this case, also defines an axis of rotation R (shown in FIG. 13D). In this example, the fastener 274 is a threaded screw with a flat hex-shaped head that fits into a counter-sink bore 276 formed by the lower plate 262. A raised disc section 278 of the lower plate 262 forms a top of the counter bore 276 to retain the screw. The raised disc section 278 also may support the upper plate 266. The fastener 274 extends through the raised disc section 278 and through a central bore 280 on the upper plate 262 that is sized to permit the upper plate 262 to rotate about the fastener 274. A nut 282 is shown threaded to the fastener but it will be understood that other types of fasteners or configurations may be used with or without a nut.

The support disc 264 is disposed concentrically around the axis of rotation R and the raised disc portion 278. The support disc 264 also may be secured to the lower plate 262 by screws, adhesive, or any other known attachment device so that at least a bottom portion 284 and an annular, outer, side rim 286 of the support disc 264 does not rotate for engagement with the locking mechanism as explained further below. In one form, the entire disc 264 does not rotate. In this case, the disc 264 may have a low friction top surface so that the upper plate 262 slides against the disc 264 as it rotates. Alternatively, the top portion of the disc 264 may not contact the top plate 262 at all. In this alternative, the disc 264 is used mainly with the locking mechanism 272 explained below.

In another alternative, the disc 264 may have a rotating, annular top portion that is secured to, and rotates with, the upper plate 262. In this case, the top portion of the disc rotates relative to the bottom portion of the disc. For this alternative, the disc may have a ball bearing channel or other mechanism between the top portion and bottom portion of the disc in order to facilitate the rotation of the top portion of the disc and top plate 262.

In one form, the locking mechanism 272 includes a releasable fastener such as a thumb screw 292, as shown in FIGS. 13C-13D. The thumb screw 292 extends through a horizontally extending, threaded bore 294 on a thickened, outer rim 296 on the upper plate 266. The lower plate 262 has at least one upwardly extending protrusion 298 with a horizontally extending bore 287. The upper plate 266 can be pivoted so that the upper plate bore 294 is aligned with the lower plate bore 289 so that the thumb screw 292 can be placed through both of the bores 289 and 294 which locks the upper plate 266 so that it cannot rotate. In one alternative, the lower plate 262 has two oppositely positioned protrusions 298 as shown in FIG. 13C to lock the upper plate 266 to the lower plate 262 in either a 0 degree or a 180 degree position. Of course, it will be appreciated that many more protrusions with bores may be provided to allow the upper plate 266 to be secured into desired positions about the axis of rotation R.

When the thumb screw 292 is disengaged from the lower plate bore 287, the upper plate is free to rotate upon screw 274. The thumb screw 292 may be held in the upper plate bore 294 while the upper plate rotates. In one form, the upper plate bore 294 is place on the opposite side of the upper plate 266 from the side near the wet grinding stone 254 so that the thumb screw 274 cannot be rotated under the grinding stone 265 where the thumb screw could get wet from splashing water.

Once rotated to a desired position that is not in front of one of the protrusions 298, the thumb screw 292 is screwed radially inward until it engages the outer rim 286 of the support disc 264 to lock the upper plate 262 in place in the rotated orientation. The locking engagement between the thumb screw 274 and the outer rim 286 may be a friction engagement, such as that of a set screw, so that the top plate 266 may be pivoted to any desired angle relative to the 0 degree position shown in FIGS. 13A-13B. In the alternative, or additionally, the outer rim 286 may have one or more holes spaced around the outer rim 286 at desired positions to receive the screw 274 to lock the top plate 262 at certain angles. In this case, the holes may be spaced uniformly around the outer rim 286 such as at every 10, 15, or 30 degree position around the disc 264 as an example. A benefit of having holes spaced around the rim (or predetermined settings) is that the sharpener can be quickly placed into a desired position by the user. Alternatively, however, a benefit of using a simple frictional engagement between the set screw and the outer rim 286 of disc 264 is that the user can quickly and easily mount the sharpener at an angle he or she desires. Other configurations for the engagement between the outer rim 286 and the thumb screw 274 will be apparent.

Figure 13E:
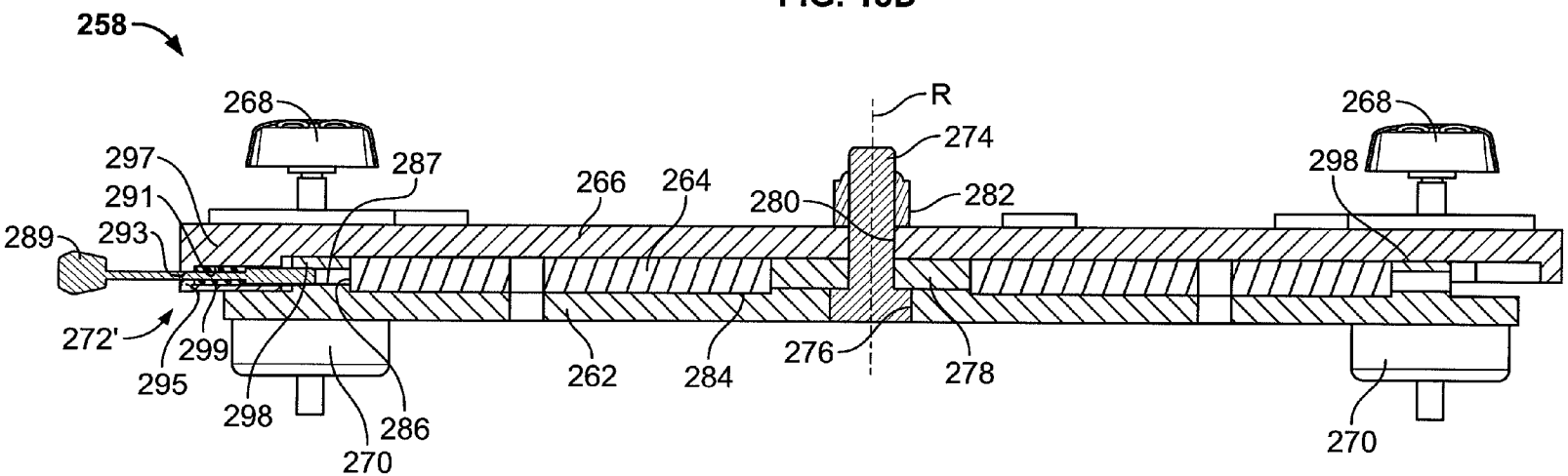
FIG. 13E is a close-up, cross-sectional side view of an alternative configuration for the pivot table of FIG. 13C.

Referring to FIG. 13E, for one alternative locking mechanism 272', a spring biased pin 289 is used instead of a thumb screw 274. The pin 289 extends through a bore 291 that has a reduced diameter opening 293 formed by an outer wall 295 on the thickened outer rim 296 of the upper plate 266. The pin 289 has a shoulder 297 to compress a spring 299 between the shoulder 297 and the outer wall 295 which biases the pin 289 radially inward and toward the protrusion 298 and/or the support disc 264. The pin 289 is manually pulled radially outward to disengage it from the protrusion 298 and/or the support disc 264. Otherwise, the operation is the same as that of locking mechanism 272.

It will be understood that the locking mechanism may take many different forms instead of, or in addition to, the biased pin and thumb screw configurations described above. For example, the locking mechanism may use a vise-type clamp on the exterior and outer periphery of the lower and upper plates 262 and 264. Such a clamp may be separable from, integral with, or permanently fixed to the plates 262 and 264. In other options, the locking mechanism may use a cam to rotate and engage an outer rim of the upper plate 262 or a support portion thereof. In yet other configurations, the upper plate may be connected to a radially extending handle that engages a circumferentially or linearly extending configuration opposing the handle and that locks the handle, and in turn, the upper plate in place. Such a configuration may be a ratchet or slide that locks the handle in a certain radial position or that the handle may be locked to, such as by a fastener.

Referring now to FIGS. 14-18, a camber jig 300 is provided to hold tools such as a flat hand plane iron 308 (shown in FIGS. 17-18) in order to form a cambered or curved cutting edge 310 disposed on the underside 307 of the tool 308 where the axis of rotation of the curved surface 310 is non-parallel, and in one example perpendicular, to the axis of rotation A of the grinding wheel 42. While the camber jig 300 is designed to work ideally with flat tools, the jig can be used to sharpen any tool that can be held steady by the jig.

Figure 14:
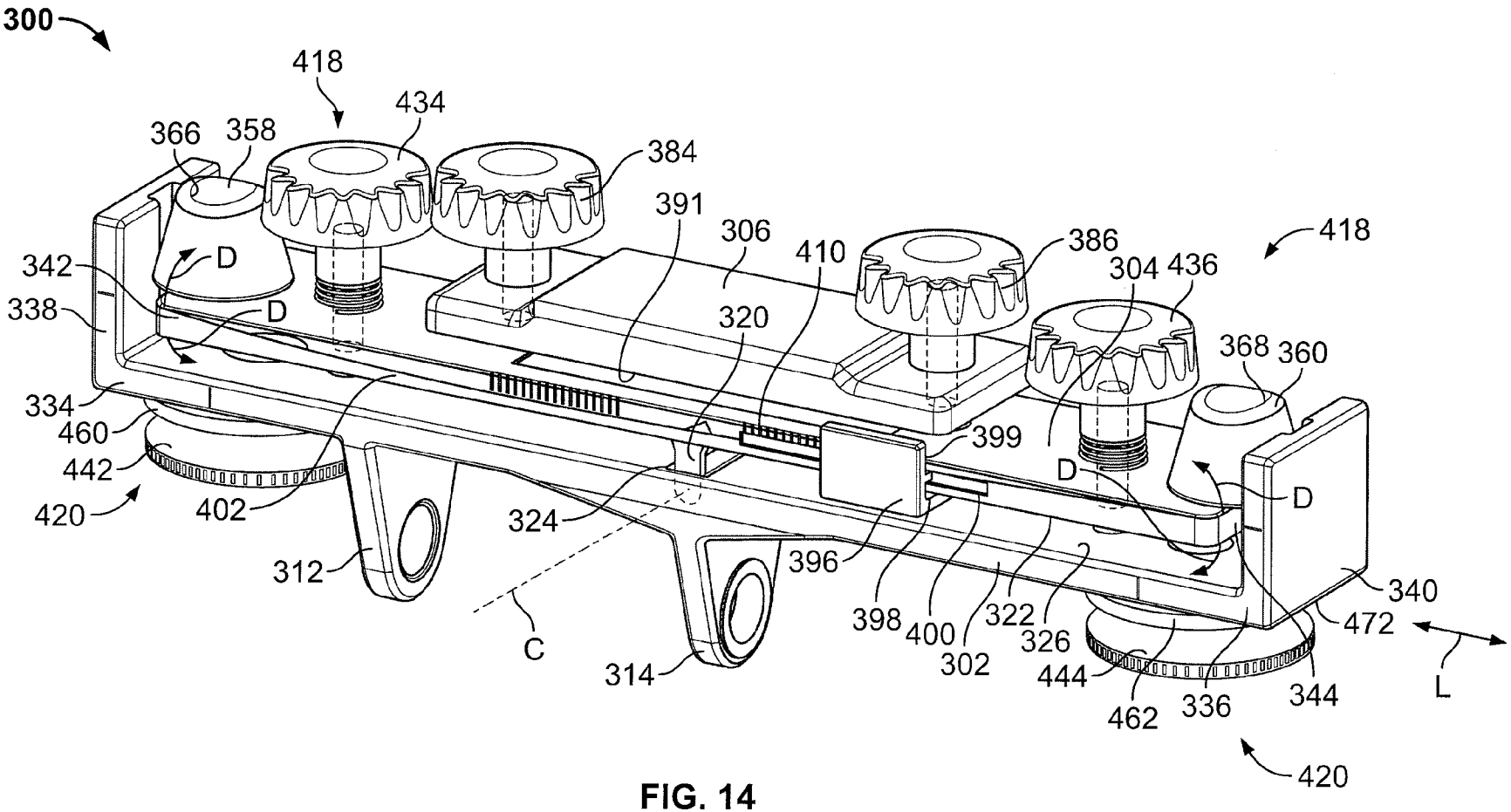
FIG. 14 is a front, perspective view of a jig employing features of the present invention for use with the wet sharpener of FIG. 1.

The camber jig 300 has a base 302 rotatably mounted on one of the horizontal support bars 68 of the tool sharpener 10. As shown in FIG. 14, a pivoting member 304 is pivotally mounted on the base 302 so that it can at least rock in a seesaw motion (as shown by Arrows 'D') above the base 302. A securing mechanism 305, such as a clamping plate 306 as one example, is mounted on the pivoting member 304 to clamp the tool 308 between the clamping plate 306 and the pivoting member 304.

Figure 15:
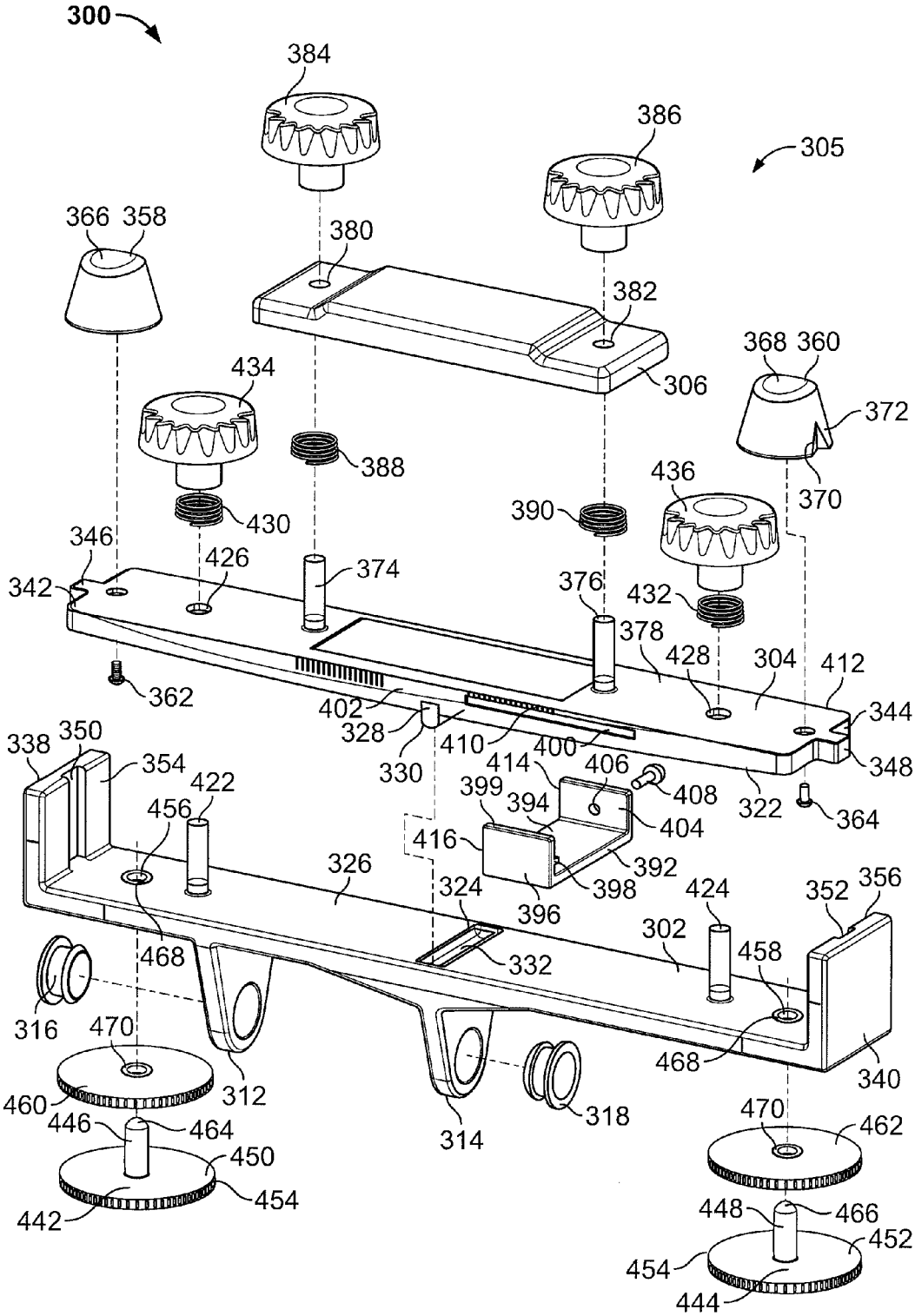
FIG. 15 is an exploded perspective view of the jig of FIG. 14.
Figure 17:
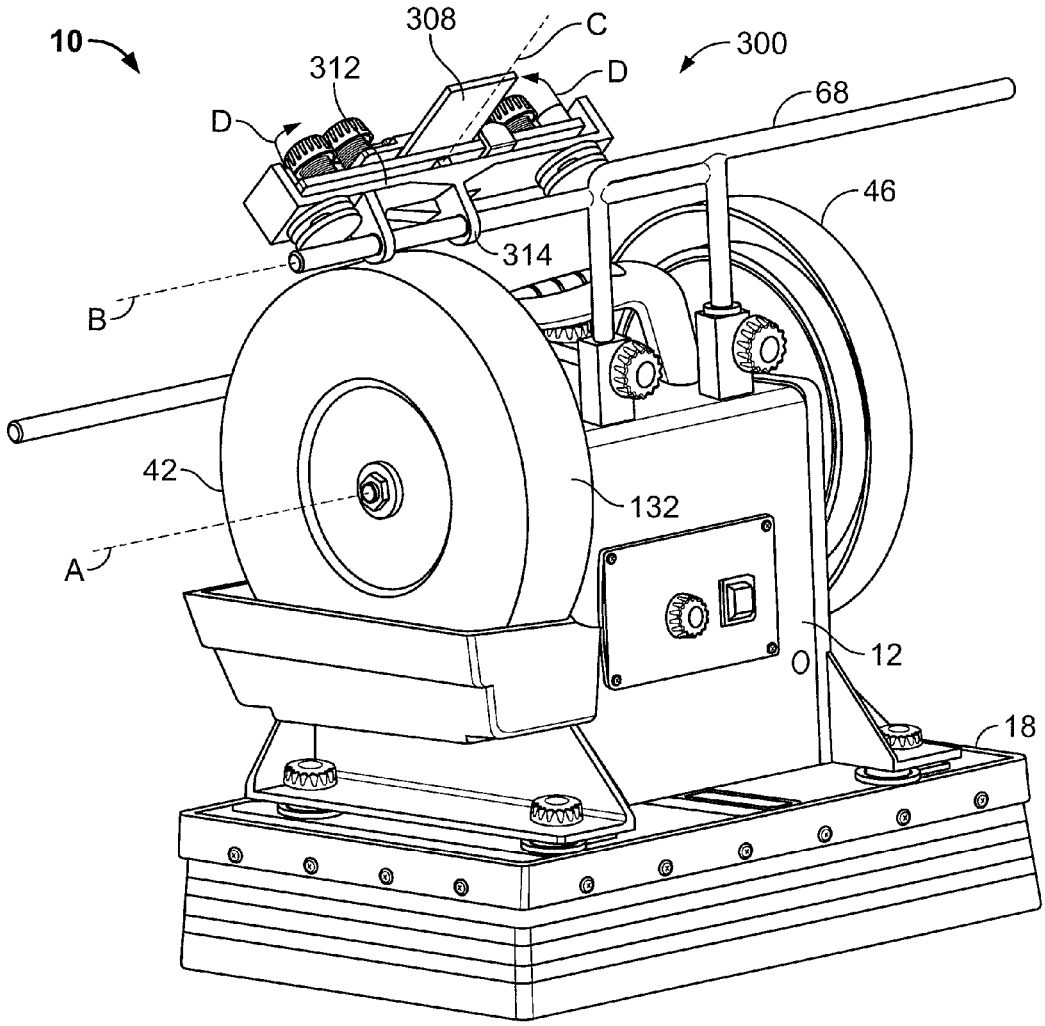
FIG. 17 is a back and right side perspective view of the wet sharpener of FIG. 1 with the jig of FIG. 14.

As shown in FIG. 15, two mounting collars 312, 314 extend downward from the base 302 and are aligned linearly to receive the support 68 (shown in FIG. 17). In one alternative, each mounting collar 312, 314 has a rotating, hard plastic, mounting ring 316, 318 that is used to provide a snug fit on the support 68 and provides smooth rotation around the support 68 and its longitudinal axis 'B' on FIG. 17. This permits the tool 308 to be positioned at multiple angles relative to the grinding stone 42 or to be rotated during grinding to create a curved cutting edge with a rotational axis parallel to the axis of rotation A of the grinding stone 42.

A fulcrum 320 extends downward from a bottom surface 322 of the pivoting member 304 and is received by a recess, such as indent 324, in the middle of the top surface 326 of the base. In this example, the fulcrum 320 is an elongated wall 328 with a distal end 330. The indent 324 has a corresponding semi-circular bottom 330. The indent 324 is dimensioned larger than the fulcrum 320 to permit the fulcrum to rock laterally within the indent 324. With this configuration, the pivoting member 304 pivots in a seesaw motion relative to the base 302 and about an axis of rotation 'C' (shown in FIG. 17), which is transverse to both the axis 'B' of the support 68 and the grinding stone's rotational axis 'A'. The axis C is formed at the fulcrum 320 as shown in FIG. 14.

Figure 18:
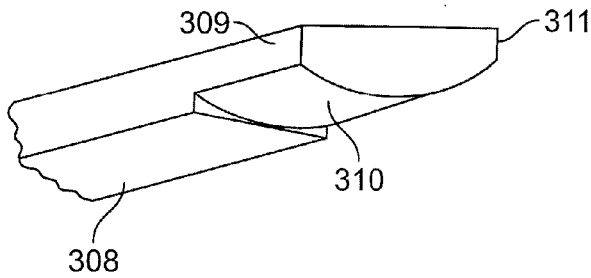
FIG. 18 is an enlarged, perspective view of an end of a tool to be sharpened by the tool sharpener of FIG. 1.

It will be appreciated that the fulcrum can have any shape that permits the pivoting member 304 to rock in at least seesaw fashion about axis 'C'. Thus, the fulcrum 320 could be shortened and/or rounded to permit a pivoting member to rock back and forth perpendicular to axis 'C' or in any number of other directions in addition to the direction of the current seesaw motion. In addition, while fulcrum 320 is shown to be integrally formed with the pivoting member 304, many other configurations will work just as well such as the fulcrum being separate to all other parts or integral to the base 302 instead. In other options, fulcrum 320 need not be in the longitudinal center of the pivoting member 304 and base 302, and may be placed off-center instead or may even be adjustable so that the position of the fulcrum is selectable along the bottom surface 322 of the pivoting member 304. At a minimum, the fulcrum 320 need only be positioned under the center of the tool 308 so that rocking the tool back and forth produces a symmetrical curved cutting edge where symmetrical for reference here is from lateral side to lateral side 309, 311 as shown in FIG. 18.

The base 302 is elongated and has two opposing, longitudinal ends 334, 336. At least one of the ends 334, 336, but preferably both ends, have a wall 338, 340 respectively, extending upward from the top surface 326 of the base 302. The walls 338, 340 are disposed in the vicinity of the one of the opposing, longitudinal ends 342, 344 of the pivoting member 304. The ends 342, 344 of the pivoting member 304 are configured for engaging the walls 338, 340 respectively in order to secure the pivoting member 304 laterally on the base 302 while permitting the pivoting member 304 to move vertically in the rocking or seesaw motion. Thus, each end 342, 344 of the pivoting member 304 respectively has a protrusion or tab 346 or 348 that extends horizontally to its corresponding wall 338, 340. The tabs 346, 348 (as shown in FIG. 15) are received by elongated, vertically extending slots 350, 352, on the interior face 354, 356 of the walls 338, 340 respectively. It will be appreciated that the tab-slot connection described here can be replaced with any equivalent engagement between the pivoting member 304 and the base 302 as long as the pivoting member 304 is secured laterally while still permitting it to move in a seesaw motion.

Referring to FIG. 15, each of the ends 342, 344 of the pivoting member 304 has a rocking knob 358, 360 respectively that is secured by a fastener 362, 364 to the pivoting member 304. The knobs 358, 360 taper inward from bottom to top, and have a top indent 366, 368 shaped for receiving a user's thumb. The knobs 358, 360 are made of a non-slip plastic or rubber sturdy enough to receive the fastener 362, 364 directly although any other sufficient structure for receiving the fasteners may be used. As shown in FIG. 15, each knob 358, 360 has two spaced notches 370 that form an outwardly extending portion or protrusion 372. The protrusions 372 are sized to fit within one of the slots 350, 352 on the base walls 338, 340 along with the tabs 346, 348 of the pivoting member 304.

The rocking knobs 358, 360 are provided so that a user can hold the ends of the camber jig 300 in their hands and conveniently place their thumbs respectively on the two rocking knobs 358, 360 to rock the pivoting member in the seesaw motion. Thus, pressing alternatively on the knobs alternatively lowers the ends 342, 344 of the pivoting member 304 towards the base 302.

In order to secure the tool 308 to the camber jig 300, the securing mechanism 305 includes two threaded posts 374, 376 that extend upward from a top surface 378 of the pivoting member 304. The clamping plate 306 has two spaced holes 380, 382 that correspond to the positions of the posts 374, 376 respectively. The securing mechanism 305 has corresponding plastic, gnarled locking caps 384, 386 each with internally threaded stems 385, 387 respectively for engaging the posts 374, 376. Resilient members 388, 390, such as conical, helical springs, are disposed on the posts and between the clamping plate 306 and the top surface 378 of the pivoting member 304. This biases the clamping plate upward to maintain an opening 391 (shown in FIG. 16) between the clamping plate 306 and the pivoting member 304 to conveniently receive the tool 308 without cumbersome manipulation of the pivoting member and clamping plate. Tightening the locking caps 384, 386 on the posts 374, 376 clamps the tool 308 between the clamping plate 306 and the pivoting member 304.

The camber jig 300 also has an alignment bracket 392 for positioning the tool 308 perpendicular to the longitudinal direction L of the jig 300 (shown in FIG. 14). The bracket 392 has a bottom wall 394 extending laterally along the bottom surface 322 of the pivoting member 304, and has a front wall 396 with a horizontally extending rib 398 disposed along an interior surface 399 of the wall 396 (best seen in FIG. 14). The rib 398 engages, and slides within, a horizontally extending slot 400 on either a front edge 402 or a back edge 412 of the pivoting member 304.

As shown in FIG. 15, the bracket 392 also has a back wall 404 opposing the front wall 394 and has a hole 406 for receiving a threaded fastener 408 including a gnarled knob with an internally threaded stem that in turn holds a threaded shank. The fastener 408 points toward, and engages, the slot 400 so that when loosened, the fastener slides horizontally within the slot so that the bracket can be moved longitudinally on the pivoting member 304. Tightening the fastener 408 against the slot 400, locks bracket 392 in a longitudinal position along the pivoting member 304.

An array of grooves 410 extends horizontally along the front and back edges 402, 412 and along the slot 400. The fastener 408 is wide enough to engage and be secured laterally within the grooves 410, and the user may center the tool 308 on the pivoting member 304 by counting the grooves 410 from the center of the mounted tool to the two lateral edges 309, 311 of the tool. Aligned sidewalls 414, 416 on the bracket 392 abut the tool 308 to ensure the tool is perpendicular to the longitudinal direction L of the camber jig 300. The bracket 392 also is reversible (i.e., the fastener 408 can face toward the front or the back of the jig 300).

Figure 16:
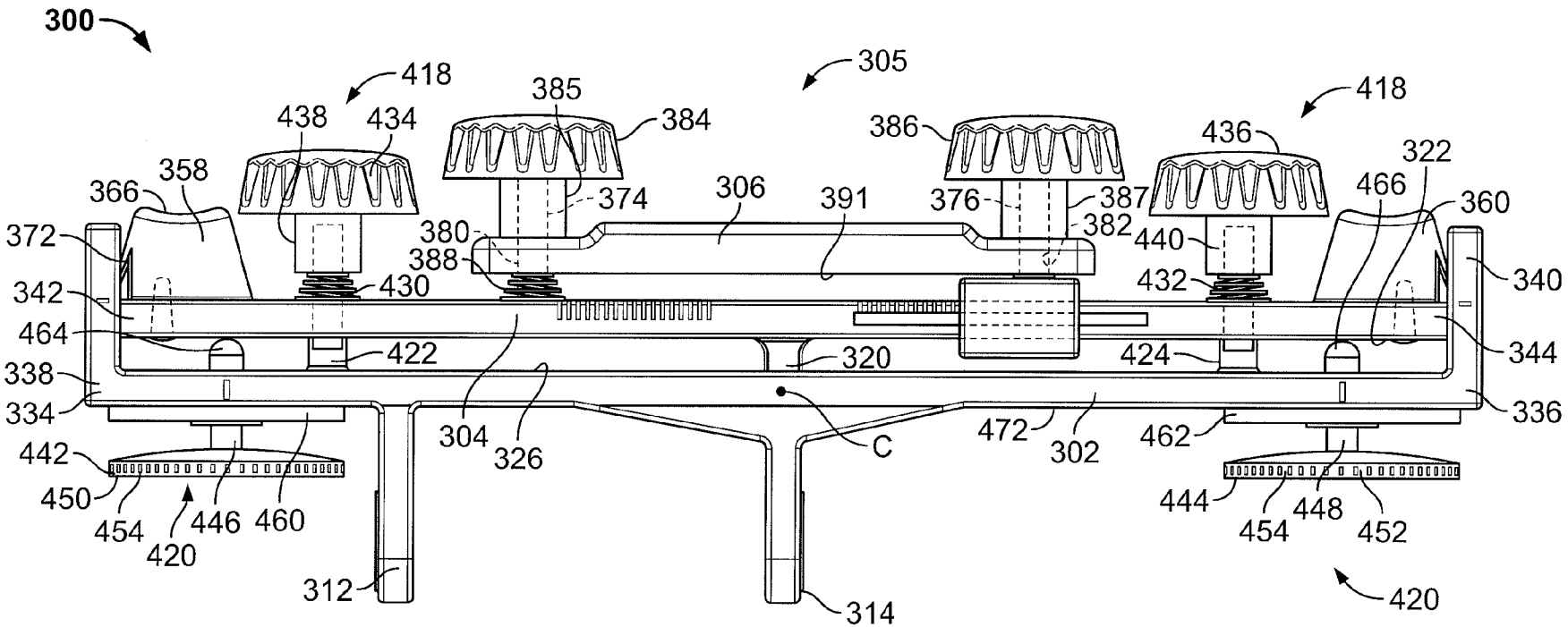
FIG. 16 is a front, elevational view of the jig of FIG. 14.

Referring to FIGS. 14 and 16, the camber jig 300 has two upper stopper devices 418 and two downward stopper devices 420, one on each side of the fulcrum 320, that are used to stop the seesaw motion of the pivoting member 304 at a selected position above the base 302 or to hold the pivoting member 304 in a selected position whether or not this position is exactly horizontal (e.g., parallel to the base 302) as shown in FIG. 16 or in any leaning or slanted position.

Each upward stopper device 418 has a threaded locking post 422 or 424 extending upward from the top surface 326 of the base 302. The locking posts 422, 424 extend through slots 426, 428 respectively (shown on FIG. 15) and respectively engage resilient members 430, 432 such as helical, cone-shaped springs, and locking caps 434, 436. The locking caps may have gnarled knobs and stems 438, 440 with interior threads (not shown). The stems 438, 440 sit upon the springs 430, 432 to bias the pivoting member 304 downward. The locking caps 434, 436 are individually adjustable so that one cap can be threaded further down on the posts 422 or 424 than the other to hold the pivoting member 304 in a desired slanted position. The slots 426, 428 are long enough to permit the locking posts 422, 424 to move laterally within the slots so that the posts 422, 424 do not interfere with the rocking motion of the pivoting member 304.

The downward stopper devices 420 have a screw 442 or 444 with a threaded shank or similar type of post 446, 448 respectively, and an oversized, circular, generally flat head 450, 452 with a gnarled outer rim 545. The posts 446, 448 extend upward through holes 456, 458 on the base 302. A threaded locking washer 460, 462 is respectively mounted on the posts 446, 448 and disposed below the base 302. The posts 446, 448 both have rounded distal ends 464, 466 for abutting the bottom surface 322 of the pivoting member 304. Both the holes 456, 458 and the locking washers 460, 462 may have threaded bushings 468, 470 in order to form the fine threads that engage the posts 446, 448 when it is more cost efficient such as when the camber jig is forged such that creating fine threads is relatively expensive on forged pieces. The bushings 468, 470 may be of a different type of material than that of the remainder of the camber jig 300 such as brass. The bottom surface 322 of the pivoting member 304 may or may not have an indent (not shown) aligned with the posts 446, 448 to prevent any lateral slipping of the posts against the bottom surface 322.

In operation, the washers 460, 462 are threaded away from the base 302 so that the screws 442, 444 are free to be axially adjusted up and down through the holes 456, 458 to a desired height to set the minimum height of the pivoting member 304 above the top surface 326 of the base 302 for that corresponding side of the jig 300. Once the desired position is reached, the washers 460, 462 are threaded up along the posts 446, 448 and tightly against the bottom surface 472 of the base 302 for locking the screws 442, 444 axially in place. The downward stopper devices 420 are also individually adjustable so that the pivoting member 304 can be maintained in a horizontal position or in any slanting position so that one end 342, 344 of the pivoting member 304 is higher above the base 302 than the other end of the pivoting member.

It will be appreciated that many other configurations exist for the upward and downward stopper devices 418, 420 as long as the structure is adjustable to set the limits of the rocking motion of the pivoting member and/or to maintain at least one end of the pivoting member 304 in a horizontal, relative to the base, or slanted position when a range of positions are available.

It will also be appreciated that the camber jig 300 will still operate even though the pivoting member 304 is not positioned entirely over the base 302 of the jig. Thus, the pivoting member 304 may be longer or wider than the base 302 so that it extends beyond the base and has free ends that reciprocate up and down without direct attachment to the base 302 as long as the pivoting member 304 can hold a flat tool for forming a cambered cutting edge on the tool. The attachment between the base 302 and pivoting member 304 may even be minimal such that the fulcrum 320 may be the only attachment between the pivoting member 304 and the base 302.

Figure 19:
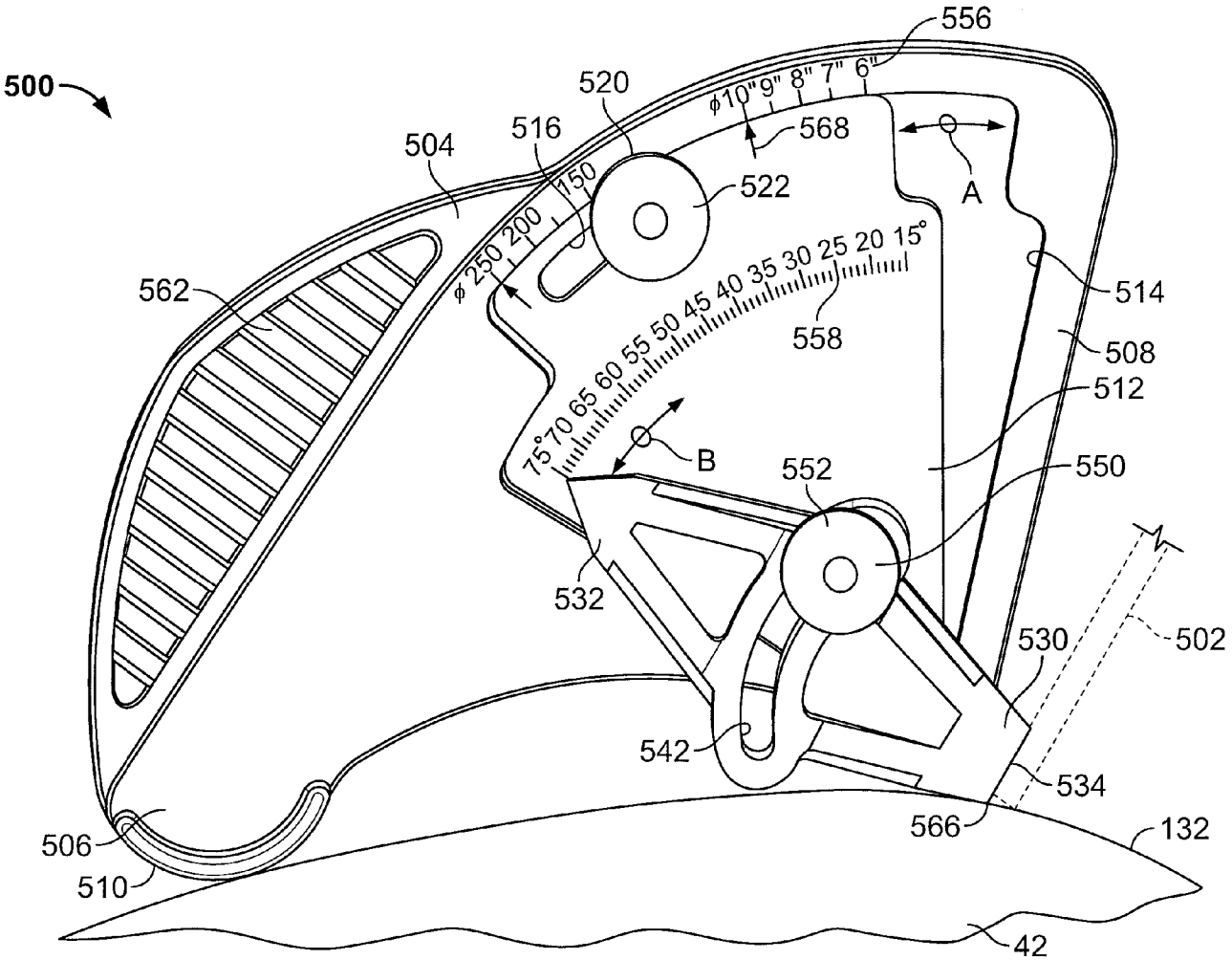
FIG. 19 is a front elevational view of a grinding angle gauge employing features of the present invention for use with the tool sharpener of FIG. 1.
Figure 20:
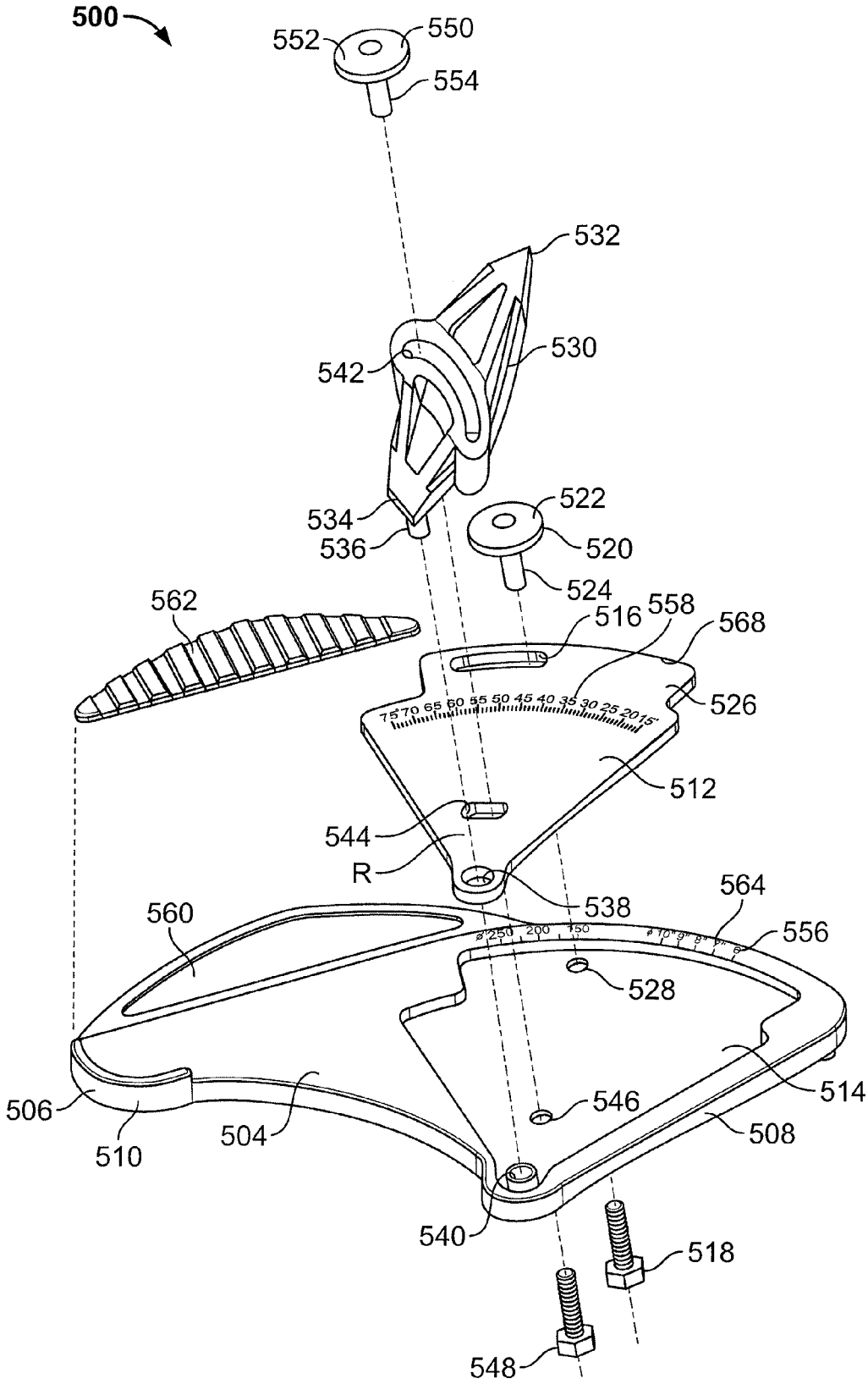
FIG. 20 is an exploded perspective view of the grinding angle gauge of FIG. 19.

Referring now to FIGS. 19-20, a grinding angle gauge 500 is used for positioning a tool or tool support 502 at a desired angle relative to the outer rim 132 of the grinding stone 42 as shown in FIG. 19. The gauge 500 has a generally, flat, plastic body 504 with a first end 506 opposing a second end 508. A widened, semi-circular periphery 510 terminates the first end 56 and is used for abutting the outer rim 132 of the grinding stone 42. A flat, plastic, generally arrow shaped scale member 512 (where the tip of the arrow is at the axis of rotation) is rotatably mounted on the second end 508 of the body 504. The body 504 has a recess 514 that is configured with a shape that corresponds to, but is slightly larger than, the scale member 512 so that the scale member can slide or rotate within the recess. The scale member 512 has a slot 516 extending circumferentially relative to the axis of rotation R. A threaded fastener 518 extends through slot 516 and engages a locking knob 520 with a gnarled head 522 and a stem 524. The locking knob is placed over the slot 516 and is wider than the slot so that it clamps down on a top surface 526 of the scale member 512 when engaging the fastener 518. The body 504 has a hole 528 in the recess 514 for permitting the screw to extend through it and to the slot 516.

The gauge 500 also has an angle indictor 530 that has a pointed end 532 and an opposing, back, flat end 534 that extends perpendicular to the longitudinal direction of the indicator 530. The indicator 530 has a downwardly extending stem 536 for mounting through a hole 538 on the scale member 512 and into a mounting collar 540 integrally formed with, or otherwise attached to, the body 504 and centered at the axis of rotation R for the scale member 512 and the indicator 530. A circumferentially extending slot 542 on the indicator 530 aligns with a slot 544 on the scale member 512, which is long enough to permit full rotation of the scale member 512 within the recess 514. The two slots 542 and 544 align with a hole 546 where both slots and the hole receive a fastener 548. A locking knob 550 engages the fastener 548 and is disposed on top of the indicator 530. Similar to locking knob 520, the locking knob 550 has a wide gnarled head 552 for grasping and a stem 554 with interior threading for engaging the fastener 548. The outside diameter of the stem 554 is wider than slot 542 for locking the indicator 530 against the scale member 512 and body 504.

The scale member 512 has at least one arrow 568, though two are shown, displayed on the top surface 526 of the scale member 512 and pointing toward grinding stone diameter indicia 556 arranged circumferentially along an upper edge 564 of the body 504. Angle indicia 558 also extends circumferentially on the top surface 526 of the scale member 512 and where the pointed end 532 can point to the indicia 558. The body 504 also has a recess 560 on both sides of the body 504 (only one side is shown) for receiving a grooved handle grip 562 that is adhered to the body 504.

In operation, first the knobs 520 and 550 are loosened so that the scale member 512 and indicator 530 are free to rotate about the mounting collar 540 and rotational axis R. The scale member 512 is then rotated until the arrow 568 on the scale member 512 is aligned with the current diameter of the grinding stone 42 as indicated by the indicia 556 on the body 504. With the knob 520 turned to lock the scale member 512 in place, knob 550 can be loosened or tightened as needed to move the indicator 530 without moving the scale member 512.

In order to determine the angle of an implement 502 such as a tool, jig or support, relative to the grinding stone, the angle gauge 500 is placed on the grinding stone 42 so that the periphery 510 of the body 504 rests on the grinding stone 42 and the left or inner corner 566 of the flat end 534 of the indicator 530 also rests on the outer rim 132 of the grinding stone 42. The flat end 534 of the indicator 530 is placed flush against the implement 502 at the angle grinding is to take place. In this position, as shown in FIG. 19, the pointed end 532 of the indicator 530 points to the indicated angle on the array of indicia 558. The angle on the indicia actually represents the angle of the tool 502 relative to the tangent on the outer rim 132 of the grinding stone 42 where the indicator 530 touches the outer rim 132. In order to place an implement 502 at a desired angle, the indicator 530 is first rotated to point to the desired angle and secured before the implement 502 is placed flush against the flat end 534 of the indicator 530.

Figure 21:
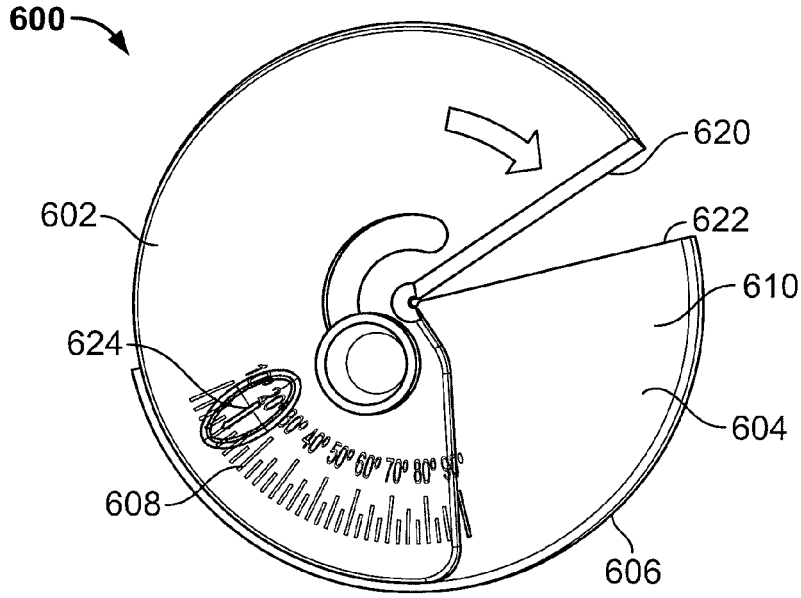
FIG. 21 is a perspective view of a cutting angle gauge embodying features of the present invention for use with the tool sharpener of FIG. 1.
Figure 22:
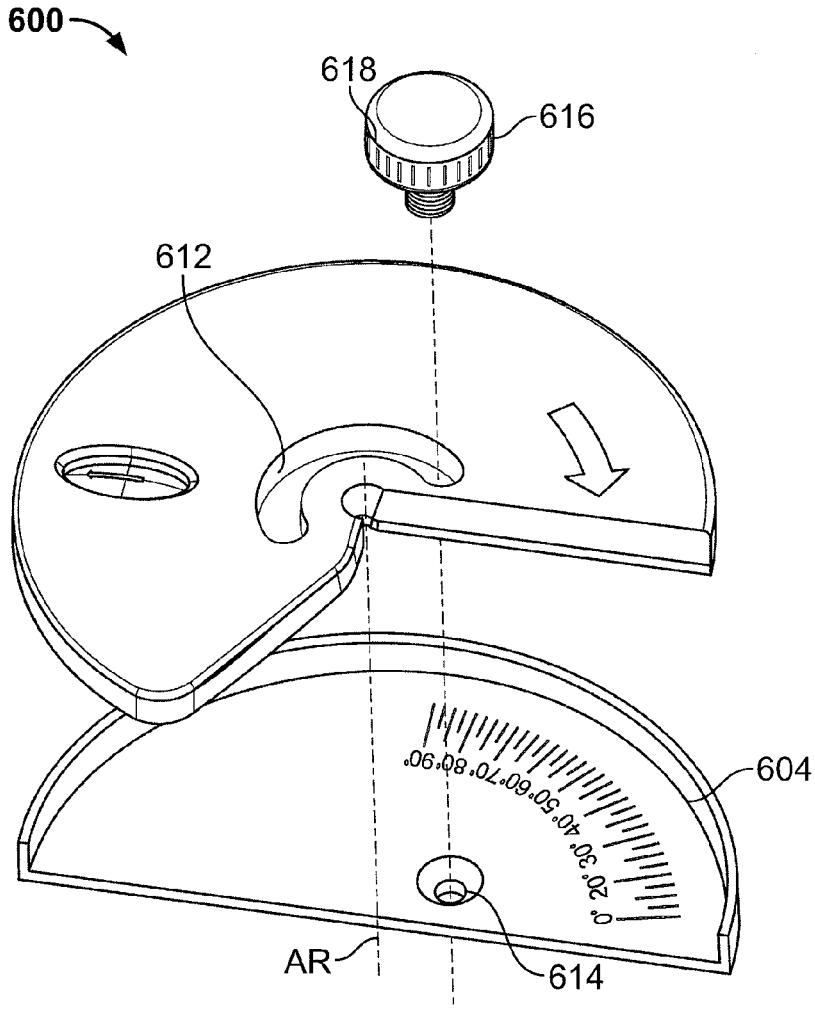
FIG. 22 is an exploded, perspective view of the cutting angle gauge of FIG. 21.

Referring to FIGS. 21-22, a cutting edge angle gauge 600 is used to measure the cutting edge angle on a sharpened tool (not shown). The angle gauge 600 has a first member 602 such as a generally circular plate with a sector missing and is made of generally transparent plastic. The first member 602 is mounted on a second member 604 which is a semi-circular piece of metal with a raised outer rim 606 and angle indicia 608 displayed on its upper face 610. Indicia 608 is positioned so that it is visible through the first member 602. A pointer 624 aligns with the indicia 608 and is either a part of the structure of the first member 602 (e.g., molded with, etched on, fastened on, or adhered to the first member 602) or pointer 624 is indicia displayed on the first member. It will be appreciated, however, that the gauge is not limited to any one material for the first and second members or structure of the pointer and array of indicia as long as one member has a pointer that can be to indicate certain indicia on an array of indicia on the other member.

The first member 602 has a circumferential extending slot 612 that is centered around an axis of rotation AR. A hole 614 is provided on the second member 604 and is aligned with the slot 612 so that a fastener 616 such as a screw, can extend through the slot 612 and thread to the hole 614. The fastener 616 has an enlarged, gnarled head 618 that can be tightened against the first member 602 to secure it in a selected position on the second member 604.

In operation, a first side (not shown) of the tool's cutting edge is placed flush against a first measuring edge 620 on the first member 602, and the bottom member 604 is then be rotated until its second measuring edge 622 extends flush against a second side (not shown) of the cutting edge on the tool so that the first and second measuring edges 620, 622 represent the angle of the cutting edge on the tool. So positioned, the pointer 624 then indicates the angle of the cutting edge on the indicia array 608.

Figure 23:
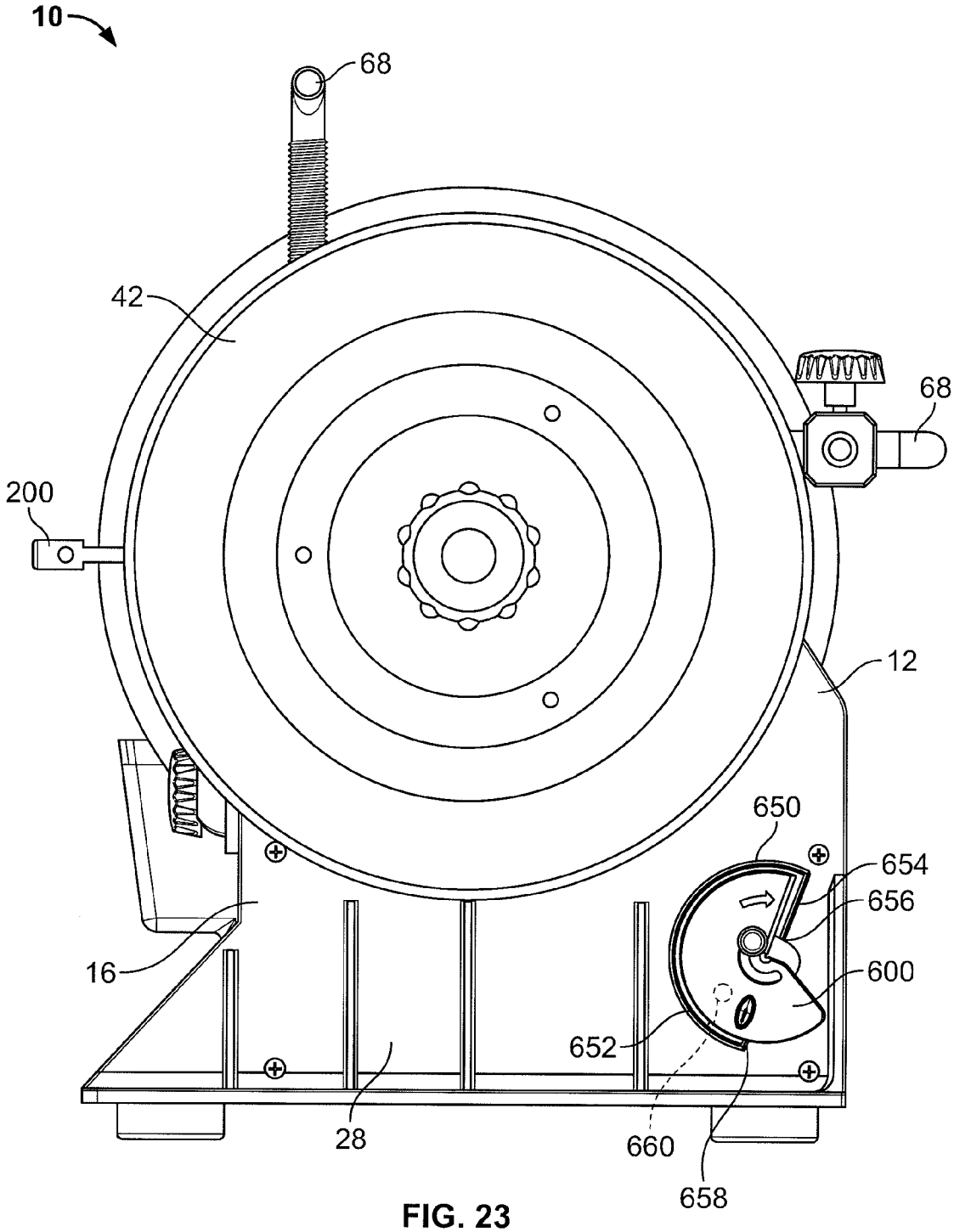
FIG. 23 is a right side elevational view of the gauge of FIGS. 21-22 mounted on the tool sharpener of FIG. 3.

Either of the gauges 500 and/or 600 may be mounted on one of the panels 20, 22, 24, 26 and/or 28 of the housing 12 or on the base 18 for convenient storage. As shown on FIG. 23, for example, one of sidewalls 14, 16 of the housing 12 is provided with a pocket 650 formed by a raised rib 652 that has a shape corresponding to the shape of the gauge to be held, in this case cutting edge angle gauge 600. Thus, the rib 652 is generally C-shaped, with a linear portion 654 and two ends 656 and 658. Either the rib 652 is sized so that the gauge 600 fits snugly within the rib, or, as in this case, a magnet 660 is disposed on the sidewall 16 or on the back of the gauge 600 to secure the gauge 600 to the sidewall 16. Grinding angle gauge 500 could also be secured to the housing 12 or base 18 in a pocket with a magnet mounted on the back of the plastic body 504. Otherwise, it will be appreciated that the pocket 650 can be used to hold many other instruments with many different shapes whether with a rib as shown or with other structures such as a pocket with an outside wall.

Figure 24:
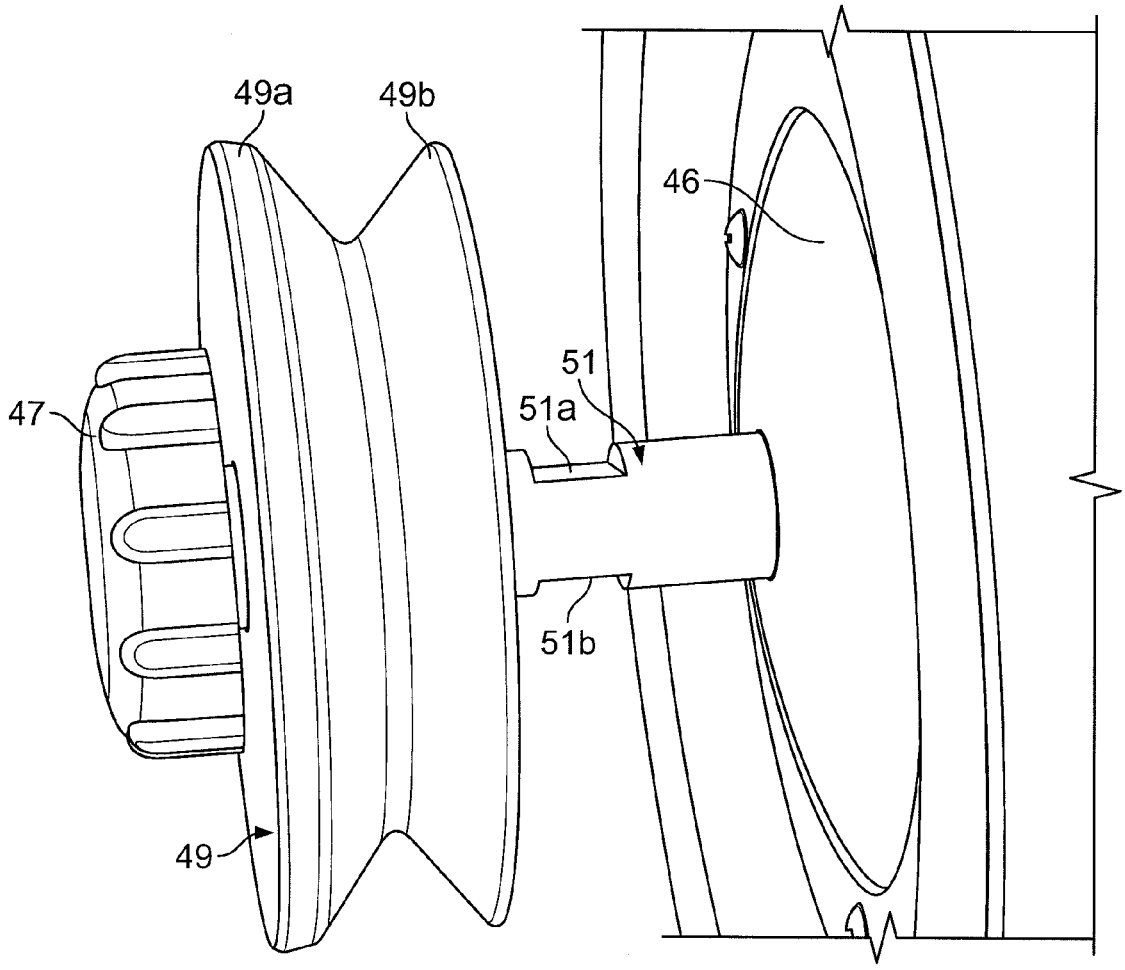
FIG. 24 is a perspective view of a secondary honing wheel connected to the main honing wheel of the tool sharpener of FIG. 1 for use with curved or angled cutting tools.

Lastly, in addition to the accessories mentioned above, the sharpener 10 may also include a secondary honing wheel which is shaped to allow angled or curved surfaces of the tool being sharpened to be honed and polished. For example, in the embodiment illustrated in FIG. 24, a secondary honing wheel, such as the back-to-back frusto-conical or hour glass shaped wheel 49, is attached to the axel 44 and rotated thereby along with the primary honing wheel 46. The flanged ends 49*a* and 49*b* of the secondary honing wheel 49 may be used to hone and polish the inside of gouges, chisels and other U-shaped or V-shaped tools.

In the embodiment illustrated, a shank 51 is provided with internal threads, such as a threaded bore, on one end and external threads, such as a bolt portion, on the opposite end. To install the secondary honing wheel, the honing wheel fastener 47 and washer (if any) are removed from the threaded end 44*b* of axel 44 and the threaded bore end of shank 51 is fastened to threaded end 44*b* of axel 44. A mating surface, such as flats 51*a* and 51*b*, is provided to allow a tool, such as a pliers or wrench, to be connected to the shank 51 and used to securely fasten the shank to the axel 44. Then, the secondary honing wheel 49 is installed onto the threaded bolt portion of the shank 51 so that the threaded bolt portion passes through the central opening in the honing wheel 49. The honing wheel fastener 47 and washer (if any) may then be inserted on the distal end of the threaded bolt portion of shank 51 and tightened to secure the secondary honing wheel 49 to the axel 44 and the primary honing wheel 46. Thus, when the axel 44 is driven by the motor 50, both the primary and secondary honing wheels 46 and 49 will be rotated.

In the form illustrated, the secondary honing wheel 49, like the primary honing wheel 46, is made of leather and used to hone, polish, or deburr the tool being sharpened. Of course, if desired, the secondary honing wheel 49 and shank 51 may be removed from axel 44 and left off. It also should be understood that the secondary honing wheel 49, like the primary honing wheel 46 and grinding wheel 42, can be connected to the tool sharpener 10 in a variety of different manners and with a variety of different fasteners as discussed above.

While the specification illustrates and describes particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A camber jig for holding a tool on a tool sharpener with a support disposed in front of a grinding stone with an axis of rotation, the jig comprising:

a base shiftably mounted on the support the base having a longitudinal axis;

a pivoting member pivotally mounted on the base and pivoting in at least a seesaw motion relative to the base, the pivoting member having a longitudinal axis generally parallel to the longitudinal axis of the base when the pivoting member is stationary relative to the base and a pivot axis generally transverse to a longitudinal axis of the pivoting member about which the pivoting member pivots and transverse to the axis of rotation of the grinding stone and adapted to provide a camber on the tool via pivoting the pivoting member in the seesaw motion while grinding the tool; and a securing mechanism for securing the tool to the pivoting member.

2. The camber jig of claim 1, further comprising a fulcrum mounted on the base and supporting the pivoting member.

3. The camber jig of claim 2, wherein the pivoting member is adapted to receive the tool above the fulcrum so that the tool is rocked symmetrically about the pivot axis.

4. The camber jig of claim 2, wherein the fulcrum is integrally formed with at least one of the pivoting member and the base.

5. The camber jig of claim 2, wherein the base has an indent, and wherein the fulcrum is pivotally mounted within the indent.

6. The camber jig of claim 1, wherein the support generally defines a longitudinal axis, and wherein the pivoting member only rocks in a seesaw motion about an axis generally perpendicular to the longitudinal axis of the support.

7. The camber jig of claim 1, wherein the pivoting member is adapted for receiving at least one of a generally flat tool, a flat plate, and a hand plane iron to be held against the grinding stone for sharpening.

8. The camber jig of claim 1, wherein the pivoting member has two opposing longitudinal ends, at least one of the ends being selectively reciprocated between different heights above the base.

9. The camber jig of claim 8, wherein both of the opposing ends of the pivoting member alternatively reciprocate between different heights above the base.

10. The camber jig of claim 1, wherein the base, pivoting member and securing mechanism each include at least one generally flat, elongated plate mounted one above the other, and wherein the tool is clamped between the pivoting member and the securing mechanism.

11. The camber jig of claim 1, wherein the pivoting member has two opposing ends, the camber jig further comprising an upward stopper device engaging the pivoting member for stopping at least one of the ends from moving away from the base at a predetermined height from the base.

12. The camber jig of claim 11, wherein the base has a top surface and at least one locking post extending upward from the top surface, and wherein the pivoting member has a top surface facing away from the top surface of the base and a through-hole receiving each locking post on one of the ends of the pivoting member, the upward stopper device including a locking cap axially adjustably secured to the top of each locking post.

13. The camber jig of claim 12, wherein the upward stopper device further includes at least one resilient member mounted on at least one locking post and disposed between the top surface of the pivoting member and the locking cap for biasing the corresponding end of the pivoting member downward toward the base.

14. The camber jig of claim 11, wherein the two opposing ends of the pivoting member are both disposed over the base, and wherein the upward stopper device is configured for locking the pivoting member in a slanted position where one of the ends is farther from the base than the other end.

15. The camber jig of claim 1, wherein the pivoting member has two opposing ends, the camber jig further comprising a downward stopper device engaging the pivoting member for stopping at least one of the ends from moving toward the base at a selectable height from the base.

16. The camber jig of claim 15, wherein the pivoting member has a bottom, and wherein the base has at least one aperture, the downward stopper device including an axially adjustable stopper post extending through the aperture for engaging the bottom of the pivoting member.

17. The camber jig of claim 1, wherein the pivoting member has two opposing ends, and wherein at least one of the ends of the pivoting member has at least one rocking knob configured for being pressed down to lower the corresponding end of the pivoting member toward the base.

18. The camber jig of claim 17, wherein both ends of the pivoting member have a rocking knob configured for alternatively pressing on the knobs to cause the pivoting member to rock in a reciprocating seesaw motion.

19. The camber jig of claim 17, wherein the base has a top surface facing the pivoting member, and at least one wall extending from the top surface and in a vicinity of at least one of the ends of the pivoting member, and wherein the rocking knob has a portion engaging the wall for at least securing the rocking knob laterally while permitting the rocking knob to move up and down relative to the top surface of the base.

20. The camber jig of claim 19, further comprising a tab-slot connection between the rocking knob and the wall.

21. The camber jig of claim 1, wherein the pivoting member has two opposing ends, and wherein the base has a top surface and at least one wall extending upward from the top surface and in a vicinity of at least one of the ends of the pivoting member, the end of the pivoting member being configured for engaging the wall for laterally securing the pivoting member end while permitting vertical motion of the pivoting member end relative to the top surface of the base.

22. A camber jig for holding a tool on a tool sharpener with a support bar disposed in front of a grinding stone, the jig comprising:

a base plate having a longitudinal axis rotatably mounted on the support bar;

an elongate pivot plate having a longitudinal axis generally parallel to the longitudinal axis of the base plate when the pivot plate is stationary relative to the base plate and having two opposing ends, and being pivotally mounted over the base plate, wherein at least one of the opposing ends is configured to selectively reciprocate between different heights above the base; and a clamping plate operably connected to the pivot plate for securing the tool between the pivot plate and the clamping plate.

23. The camber jig of claim 22, further comprising a fulcrum supporting the pivot plate and configured for permitting the pivot plate to rock in at least a seesaw motion above the base plate so that both of its ends alternatively reciprocate to different heights above the base plate.

24. A tool sharpener for sharpening tools comprising:

a grinding stone with an axis of rotation;

a support member for supporting a tool relative to the grinding stone;

a base having a longitudinal axis adapted to be rotatably mounted on the support member and having an axis of rotation about the support member;

an elongate pivoting member having a longitudinal axis generally parallel to the longitudinal axis of the base when the pivoting member is stationary and pivotally mounted to the base for pivoting about a pivot axis generally transverse to a longitudinal axis of the pivoting member; and a clamping member connected to the pivoting member operable to secure the tool to the pivoting member.

25. The tool sharpener of claim 24, wherein the support member is an elongate rod and is adjustable to allow the rod to be positioned at different positions with respect to the grinding stone.

26. The tool sharpener of claim 25, wherein a longitudinal axis of the adjustable support member is oriented generally parallel to the grinding stone's axis of rotation.

27. The tool sharpener of claim 24, wherein the pivoting member is adapted for receiving at least one of a generally flat tool, a flat plate, and a hand plane iron to be held against the grinding stone for sharpening.

28. The tool sharpener of claim 24, wherein the pivoting member extends laterally from the pivot axis and has opposing ends and opposing gripping portions proximal the opposing ends that may be selectively rocked about the pivot axis in a seesaw fashion relative to the base by manipulating the gripping portions, wherein the ends each have a range of motion relative to the base.

29. The tool sharpener of claim 28, wherein the tool sharpener further comprises an adjustable upward stopper device for adjustably limiting the range of motion of at least one end by engaging the pivoting member for stopping the at least one end from moving away from the base at a predetermined height from the base.

30. The tool sharpener of claim 29, wherein the base has a top surface and at least one locking post extending upward from the top surface, and wherein the pivoting member has a top surface facing away from the top surface of the base and a through-hole receiving the at least one locking post, the upward stopper device including a locking cap adjustably secured to the at least one locking post for adjustably limiting the range of motion of the at least one end of the pivoting member.

31. The tool sharpener of claim 28, wherein the tool sharpener further comprises an adjustable downward stopper device for adjustably limiting the range of motion of the at least one end by engaging the pivoting member for stopping the at least one end from moving toward the base at a selectable height from the base.

32. The tool sharpener of claim 31, wherein the pivoting member has a bottom and the base has at least one aperture, the downward stopper device including at least one adjustable stopper post extending through the respective at least one aperture for engaging the bottom of the pivoting member, thereby adjustably limiting the range of motion of the at least one end of the pivoting member.

33. The tool sharpener of claim 30, wherein the upward stopper device further includes at least one resilient member mounted on the at least one locking post and disposed between the top surface of the pivoting member and the locking cap for biasing the pivoting member downward toward the base.

34. The tool sharpener of claim 28, wherein the tool sharpener further comprises two upward stopper devices and two downward stopper devices for adjustably limiting the range of motion of both ends of the pivoting member by engaging the pivoting member for stopping the respective ends from moving toward and away from the base at predetermined heights from the base.

35. The tool sharpener of claim 24, wherein the pivoting member has an elongate configuration with opposing ends and body portions extending between the pivot axis and the respective opposing ends.

36. The tool sharpener of claim 35, wherein the tool is secured by the clamping member generally over the pivot axis of the pivoting member, such that the tool is rocked along with the pivoting member in a seesaw fashion to create a cambered profile on the tool with the grinding stone.

37. The tool sharpener of claim 35, wherein at least one pivoting member portion has at least one rocking knob defining a gripping portion configured for being pressed down to lower the corresponding end of the pivoting member toward the base.

38. The tool sharpener of claim 37, wherein the body portions of the pivoting member each have a rocking knob configured for being alternatively pressed to cause the pivoting member to rock in a reciprocating seesaw fashion.

39. The tool sharpener of claim 37, wherein the base has a top surface facing the pivoting member and at least one wall extending from the top surface and near the at least one end of the pivoting member; wherein the rocking knob has a portion engaging the wall for securing the rocking knob laterally while permitting the rocking knob to move up and down relative to the top surface of the base.

40. The tool sharpener of claim 35, wherein the base has a top surface facing the pivoting member and at least one wall extending from the top surface and near the at least one end of the pivoting member; wherein the pivoting member has a portion engaging the wall for securing the at least one end of the pivoting member laterally while permitting the at least one end to move up and down relative to the top surface of the base.

41. A camber jig for providing a curved edge to a tool on a rotatable grinding stone having a support member for supporting the jig relative to the grinding stone comprising:

a base having a longitudinal axis and a support mounting portion, wherein the base is adapted to be rotatably mounted on the support member via the support mounting portion and has an axis of rotation about the support member;

an elongate pivoting member having a longitudinal axis generally parallel to the longitudinal axis of the base when the pivoting member is stationary and being pivotally mounted to the base for pivoting about a pivot axis generally transverse to a longitudinal axis of the pivoting member; and a clamping member connected to the pivoting member operable to secure the tool to the pivoting member.

42. The camber jig of claim 41, wherein the clamping member has an elongate body with a longitudinal axis generally parallel to the longitudinal axis of the pivoting member.

43. The camber jig of claim 41, wherein the support mounting portion of the base includes a shoulder extending from the base and an aperture disposed on the shoulder for mating with the support member to allow rotational movement of the base about the support member.

44. The camber jig of claim 41, wherein the pivoting member is pivotally mounted to the base via an apex operably connected to the base that allows the pivoting member to pivot in a seesaw fashion about the apex.

45. The camber jig of claim 41, wherein the pivoting member is connected to the base via an adjustable connection that allows the pivoting member to move with respect to the base and limits a range of motion of the pivoting member.

46. The camber jig of claim 45, wherein the adjustable connection includes a post member extending from the base that protrudes through an opening in the pivoting member such that the pivoting member may pivot with respect to the base.

47. The camber jig of claim 46, wherein the adjustable connection includes a locking cap being adjustably mounted on the post member for limiting a range of travel of the pivoting member via adjusting the position of the locking cap on the post member with respect to the base.

48. The camber jig of claim 41, wherein the base includes opposing walls extending therefrom which are configured for engaging with respective ends of the pivoting member to provide lateral guidance thereto while allowing the pivoting member to move in the seesaw fashion.

49. The camber jig of claim 48, wherein each of the respective ends of the pivoting member include one of a protrusion and a groove for mating with the other of a corresponding groove or protrusion disposed on each of the opposing walls of the base to provide a tab-slot connection at either end of the pivoting member for providing lateral guidance thereto while allowing the pivoting member to move in the seesaw fashion.

* * * * *